US005389505A

United States Patent [19]

Nishigaki

[11] Patent Number: 5,389,505

[45] Date of Patent: Feb. 14, 1995

[54] SILVER HALIDE PHOTOGRAPHIC MATERIAL

[75] Inventor: Junji Nishigaki, Kanagawa, Japan

[73] Assignee: Fuji Photo Film Co., Ltd., Kanagawa, Japan

[21] Appl. No.: 113,766

[22] Filed: Aug. 31, 1993

[30] Foreign Application Priority Data

Sep. 18, 1992 [JP] Japan ..... 4-249741

[51] Int. Cl.[6] ..... G03C 1/46

[52] U.S. Cl. ..... 430/506; 430/504; 430/574; 430/583

[58] Field of Search ..... 430/574, 583, 504, 506, 430/572

[56] References Cited

U.S. PATENT DOCUMENTS

| | | | |
|---|---|---|---|
| 2,158,882 | 5/1939 | Mees | 430/574 |
| 2,159,565 | 5/1939 | Mees | 430/574 |
| 3,718,475 | 2/1973 | Shiba et al. | 430/574 |
| 3,745,014 | 7/1973 | Nakazawa et al. | 430/574 |
| 3,849,147 | 11/1974 | Shiba et al. | 430/574 |
| 4,663,271 | 5/1987 | Nozawa et al. . | |
| 4,705,744 | 11/1987 | Sasaki et al. | 430/504 |

FOREIGN PATENT DOCUMENTS

| | | |
|---|---|---|
| 2031491 | 1/1971 | European Pat. Off. . |
| 50-2537 | 1/1975 | Japan . |
| 61-34541 | 2/1986 | Japan . |

*Primary Examiner*—Thomas R. Neville
*Attorney, Agent, or Firm*—Sughrue, Mion, Zinn, Macpeak & Seas

[57] ABSTRACT

A color photographic material has on a support at least one blue-sensitive layer, at least one green-sensitive layer and at least one red-sensitive layer, and further has an emulsion layer capable of imparting an interlayer effect to the red-sensitive layer. The interlayer effect-donating layer is color-sensitized with both a sensitizing dye of formulae (I) and a sensitizing dye of formula (II):

(I)

(II)

where $R_{11}$, $R_{12}$, $R_{21}$ and $R_{22}$ each represents an alkyl group; $Z_{11}$ and $Z_{21}$ each represents a group of atoms necessary for forming a benzene ring; $Z_{12}$ represents a group of atoms necessary for forming a benzothiazzole nucleus or a benzoselenazole nucleus; $Z_{22}$ represents a group of atoms necessary for forming a benzoxazole nucleus or a naphthoxazole nucleus; $X_{11}$ and $X_{21}$ each represents a charge-balancing pair ion; and m and n each represents 0 or 1. The material has an excellent color reproducibility and gives a color image with high chroma and graininess.

6 Claims, No Drawings

SILVER HALIDE PHOTOGRAPHIC MATERIAL

FIELD OF THE INVENTION

The present invention relates to a color photographic material and, more precisely, to a color photographic material which has excellent color reproducibility and which forms high-chroma color images having excellent graininess.

BACKGROUND OF THE INVENTION

Hitherto, it has been known to utilize an interlayer restraining effect (or interlayer effect) as a means for improving the color reproducibility of a color photographic material. Referring to the example of a color negative photographic material, impartation of a development restraining effect from the green-sensitive layer to the red-sensitive layer decreases coloration of the red-sensitive layer by white light exposure as compared to coloration of the red-sensitive layer by red light exposure. Since the gradation of a color negative paper system is balanced so that exposure of the paper with a white light reproduces a gray color on the color print, the above-mentioned interlayer effect causes cyan coloration of a higher density by red light exposure on the print than by gray light exposure and, as a result, red reproduction of a higher saturation degree is possible on the print with restraining cyan coloration thereon. In the same way, the development restraining effect from the red-sensitive layer to the green-sensitive layer in the color photographic material provides green reproduction of a higher saturation degree.

One known means of elevating the interlayer effect is a method of using iodide ions to be released from silver halide emulsions during development. Specifically, in a photographic material to be processed by this method, the silver iodide content in the interlayer effect donor layer is elevated and that in the receptor layer is lowered. Another method of elevating the interlayer effect is illustrated in JP-A-50-2537 (the term "JP-A" as used herein means an "unexamined published Japanese patent application"), in which a coupler capable of releasing a development inhibitor by reaction with an oxidation product of a paraphenylenediamine developing agent in a color developer is added to an interlayer effect donor layer. Still another method of elevating the interlayer effect is a so-called automatic masking method in which a colored coupler is added to a colorless coupler so as to mask any unnecessary absorption of the colored dye from the colorless coupler. In accordance with the method of using such a colored coupler, the amount of the colored coupler to be added may be increased to cause more masking than the masking of the unnecessary absorption of colored dye from the colorless coupler to thereby yield the same effect as the intended interlayer effect.

Where the saturation (chroma) of the primary colors of red, green and blue is elevated by these methods, there occurs a drawback that the yellowish to cyanic green color hue can not be reproduced faithfully. In view of this situation, JP-A-61-34541 has proposed a technique of overcoming this drawback. Specifically, JP-A-61-34541 has proposed a color photographic material having at least one blue-sensitive silver halide emulsion layer containing yellow-coloring color coupler(s), at least one green-sensitive silver halide emulsion layer containing magenta-coloring color coupler(s), and at least one red-sensitive silver halide emulsion layer containing cyan-coloring color coupler(s) on a support, in which the center-of-gravity sensitivity wavelength (center-of-gravity $\lambda G$) of the spectral sensitivity distribution of the green-sensitive layer satisfies 520 nm<center-of-gravity $\lambda G$<580 nm, and at least one red-sensitive silver halide emulsion layer satisfies both (a) 500 nm<center-of-gravity $\lambda R$<560 nm and (b) center-of-gravity $\lambda G$-center-of-gravity $\lambda R$>5 nm where the center-of-gravity $\lambda R$ is a center-of-gravity wavelength of the distribution of the degree of interlayer effect to be imparted to the red-sensitive layer from other layers in a wavelength range of from 500 nm to 600 nm. The proposed silver halide color photographic material gives a sharp color image with faithful color reproduction.

In the proposed technique, it is preferred that the layer capable of imparting an interlayer effect to the red-sensitive layer be a magenta-coloring layer in order to prevent the layer capable of imparting an interlayer effect to the red-sensitive layer from imparting the effect additionally to the green-sensitive layer and to inhibit any unfavorable influence on the color reproduction of the material.

However, where the proposed photographic material was used for taking a picture of a person and a color print was obtained from the exposed material, it was found that the graininess was too high in the area of the skin of persons in the print. The reasons for this were analyzed and it was determined that the graininess of the magenta coloration of the silver halide emulsion layer capable of imparting an interlayer effect to the red-sensitive layer was worse than that of the other coloring layers.

The reason why the graininess of the layer capable of imparting an interlayer effect to the red-sensitive layer was worse than that of the other silver halide emulsion layers is because the sensitizing dyes which have heretofore been added to the silver halide emulsion layer to which an interlayer effect is to be imparted had a lower color sensitizing efficiency because their absorption (the center-of-gravity wavelength: 500 nm/center-of-gravity $\lambda R$<560 nm) was weak so that the sensitivity/graininess ratio was not satisfactory.

Therefore, sensitizing dyes capable of giving a strong absorption (color sensitivity) in the center-of-gravity wavelength range of from 500 to 560 nm (preferably from 520 to 540 nm for sufficient color reproduction) have been desired in the art.

SUMMARY OF THE INVENTION

The present invention has been made in consideration of the above-mentioned problems. One object of the present invention is to provide a color photographic material having a silver halide emulsion layer capable of imparting an interlayer effect to a red-sensitive emulsion layer having a center-of-gravity wavelength range of from 500 to 560 nm, which material has an excellent color reproducibility and forms a high-chroma color image having an excellent graininess.

Another object of the present invention is to provide a combination of sensitizing dyes capable of imparting a strong color sensitivity in the wavelength range of from 520 to 540 nm, in preparing the color photographic material.

The above-mentioned objects of the present invention have been attained by the following means:

1. A silver halide photographic material containing at least one sensitizing dye of the following general formula (I) and at least one sensitizing dye of the following general formula (II):

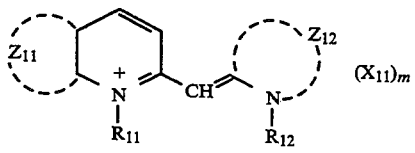

(I)

where $R_{11}$ and $R_{12}$ each represents an alkyl group;

$Z_{11}$ represents a group of atoms necessary for forming a benzene ring;

$Z_{12}$ represents a group of atoms necessary for forming a benzothiazole nucleus or a benzoselenazole nucleus;

$X_{11}$ represents a charge-balancing pair ion; and m represents 0 or 1, and when m is 0 the compound forms an internal salt;

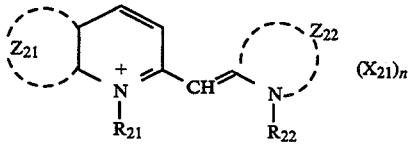

(II)

where $R_{21}$, $R_{22}$, $Z_{21}$, $X_{21}$ and n each have the same meanings as $R_{11}$, $R_{12}$, $Z_{11}$, $X_{11}$ and m, respectively, in formula (I); and $Z_{22}$ represents a group of atoms necessary for forming a benzoxazole nucleus or a naphthoxazole nucleus.

2. A silver halide color photographic material having at least one blue-sensitive silver halide emulsion layer containing yellow-coloring color coupler(s), at least one green-sensitive silver halide emulsion layer containing magenta-coloring color coupler(s), and at least one red-sensitive silver halide emulsion layer containing cyan-coloring color coupler(s) on a support and additionally having on the support at least one silver halide emulsion layer capable of imparting an interlayer effect to the red-sensitive emulsion layer, in which the layer capable of imparting an interlayer effect has been colorsensitized with at least one sensitizing dye of the abovementioned general formula (I) and with at least one sensitizing dye of the above-mentioned general formula (II).

3. The silver halide color photographic material as described in Paragraph 2 immediately above, in which the layer capable of imparting an interlayer effect has been color-sensitized with at least one sensitizing dye of the following general formula (III) and with at least one sensitizing dye of the following general formula (IV):

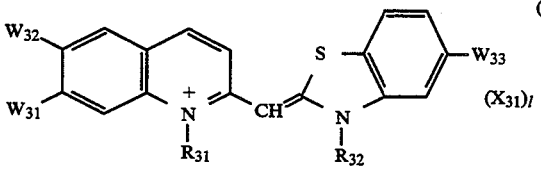

(III)

-continued

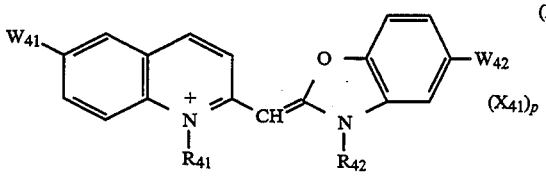

(IV)

where $R_{31}$, $R_{32}$, $R_{41}$ and $R_{42}$ each represents a sulfoalkyl group or a carboxyalkyl group;

$X_{31}$ and $X_{41}$ each have the same meaning as $X_{11}$ in formula (I);

l and p each have the same meaning as m in formula (I);

$W_{31}$, $W_{32}$ and $W_{41}$ each represents an alkyl group having 3 or less carbon atoms, a halogen atom, an aryl group or an aryloxy group; and $W_{33}$ and $W_{42}$ each represents a halogen atom or an aryl group.

DETAILED DESCRIPTION OF THE INVENTION

The present invention will be explained in more detail hereunder.

The photographic material of the present invention is a color photographic material having at least one blue-sensitive silver halide emulsion layer containing yellow-coloring color coupler(s), at least one green-sensitive silver halide emulsion layer containing magenta-coloring color coupler(s), and at least one red-sensitive silver halide emulsion layer containing cyan-coloring color coupler(s) on a support, in which at least one cyan-coloring red-sensitive silver halide emulsion layer is influenced or retarded by the interlayer effect of a silver halide emulsion layer capable of donating an interlayer effect (donor layer capable of donating an interlayer effect) which has been color-sensitized by a combination of compounds of the following general formulae (I) and (II):

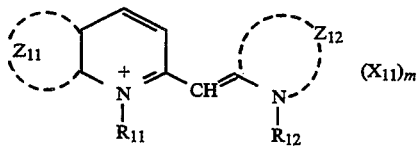

(I)

where $R_{11}$ and $R_{12}$ each represents an alkyl group;

$Z_{11}$ represents a group of atoms necessary for forming a benzene ring;

$Z_{12}$ represents a group of atoms necessary for forming a benzothiazole nucleus or a benzoselenazole nucleus;

$X_{11}$ represents a charge-balancing pair ion; and m represents 0 or 1, and when m is 0 the compound forms an internal salt;

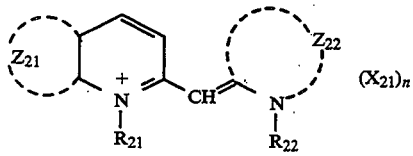

(II)

where $R_{21}$, $R_{22}$, $Z_{21}$, $X_{21}$ and n each have the same meanings as $R_{11}$, $R_{12}$, $Z_{11}$, $X_{11}$ and m, respectively, in formula (I); and $Z_{22}$ represents a group of atoms necessary for forming a benzoxazole nucleus or a naphthoxazole nucleus.

More preferably, the donor layer is color-sensitized with a combination of compounds of the following general formulae (III) and (IV):

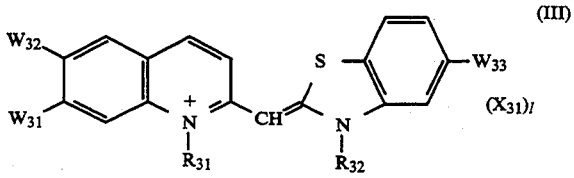

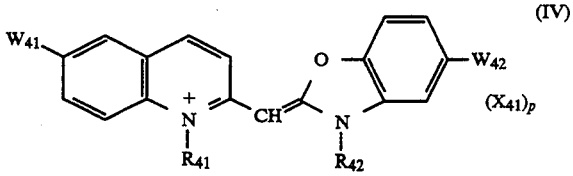

where $R_{31}$, $R_{32}$, $R_{41}$ and $R_{42}$ each represents a sulfoalkyl group or a carboxyalkyl group;

$X_{31}$ and $X_{41}$ each have the same meanings as $X_{11}$ in formula (I);

l and p each have the same meaning as m in formula (I); $W_{31}$, $W_{32}$ and $W_{41}$ each represents an alkyl group having 3 or less carbon atoms, a halogen atom, an aryl group or an aryloxy group; and $W_{33}$ and $W_{42}$ each represents a halogen atom or an aryl group.

In formula (I), $Z_{11}$ represents a group of atoms necessary for forming a benzene ring, and at least one atom of the group of atoms may optionally be substituted by an alkyl group, an alkoxy group or an aryloxy group. Preferably, the 6-position of the benzene ring to be formed by $Z_{11}$ is substituted by an alkyl group. The alkyl group by which $Z_{11}$ may be substituted includes, for example, a methyl group, an ethyl group, an n-propyl group, an isopropyl group, a t-butyl group, an n-butyl group, an n-octyl group, an n-decyl group, an n-hexadecyl group, a cyclopentyl group and a cyclohexyl group. Preferably, the alkyl group is a methyl group or an ethyl group.

The alkoxy group includes, for example, a methoxy group, an ethoxy group, a propoxy group and a methylenedioxy group; and it is preferably a methoxy group.

The aryloxy group includes, for example, a phenoxy group, a 4-methylphenoxy group and a 4-chlorophenoxy group; and it is preferably a phenoxy group.

$Z_{12}$ represents a group of atoms necessary for forming a benzothiazole nucleus or a benzoselenazole nucleus, which may optionally be substituted. Preferably, $Z_{12}$ forms a benzothiazole nucleus substituted by a halogen atom, an alkyl group, an alkoxy group, an alkylthio group or an aryl group at its 5-position. The halogen atom by which the benzothiazole nucleus may be substituted includes, for example, a fluorine atom, a chlorine atom, a bromine atom and an iodine atom; and it is preferably a bromine atom or a chlorine atom.

The alkyl group may optionally be substituted and includes, for example, a methyl group, an ethyl group, an n-propyl group, an isopropyl group, a t-butyl group, an n-butyl group, an n-octyl group, an n-decyl group, an n-hexadecyl group, a cyclopentyl group, a cyclohexyl group, a trifluoromethyl group and a hydroxyethyl group; and it is preferably a trifluoromethyl group.

The alkoxy group includes, for example, a methoxy group, an ethoxy group, a propoxy group and a methylenedioxy group; and it is preferably a methoxy group.

The alkylthio group includes, for example, a methylthio group, an ethylthio group and a propylthio group; and it is preferably a methylthio group.

The aryl group includes, for example, a phenyl group, a pentafluorophenyl group, a 4-chlorophenyl group, a 3-sulfophenyl group and a 4-methylphenyl group; and it is preferably a phenyl group.

In formula (I), the alkyl group represented by each of $R_{11}$ and $R_{12}$ may optionally be substituted. It includes, for example, an alkyl group having 8 or less carbon atoms (e.g., methyl, ethyl, n-propyl, isopropyl, n-butyl, n-pentyl, n-hexyl, n-octyl), an aralkyl group having 10 or less carbon atoms (e.g., benzyl, phenethyl, 3-phenylpropyl), and an alkyl group having 6 or less carbon atoms and substituted by substituent(s) selected from a hydroxyl group, a carboxyl group, a sulfo group, a cyano group, a halogen atom (e.g., fluorine, chlorine, bromine, iodine), an alkoxycarbonyl group having 8 or less carbon atoms (e.g., methoxycarbonyl, ethoxycarbonyl, benzylcarbonyl), an alkoxy group having 8 or less carbon atoms (e.g., methoxy, ethoxy, propoxy, butyloxy, benzyloxy, phenethyloxy), an aryloxy group having 8 or less carbon atoms (e.g., phenoxy, p-tolyloxy), an acyloxy group having 8 or less carbon atoms (e.g., acetyloxy, propionyloxy, benzoyloxy), an acyl group having 8 or less carbon atoms (e.g., acetyl, propionyl, benzoyl, 4-fluorobenzoyl), a carbamoyl group having 6 or less carbon atoms (e.g., carbamoyl, N,N-dimethylcarbamoyl, morpholinocarbonyl, piperidinocarbonyl), a sulfamoyl group having 6 or less carbon atoms (e.g., sulfamoyl, N,N-dimethylsulfamoyl, morpholinosulfonyl, piperidinosulfonyl) and an aryl group having 10 or less carbon atoms (e.g., phenyl, p-fluorophenyl, p-carboxyphenyl, p-hydroxyphenyl, p-sulfophenyl).

The alkyl group represented by each of $R_{11}$ and $R_{12}$ is more preferably a sulfoethyl group, a sulfopropyl group, a sulfobutyl group, a carboxymethyl group or a carboxyethyl group.

In formula (I), $X_{11}$ represents a charge-balancing pair ion. The ion to counterbalance the charge of the molecule is selected from an anion and a cation. The anion is an inorganic or organic acid anion (e.g., p-toluenesulfonato, p-nitrobenzenesulfonato, methanesulfonato, methylsulfato, ethylsulfato, perchlorato), or a halide ion (e.g., chloride, bromide, iodide). The cation is an inorganic or organic cation, including, for example, a hydrogen ion, an alkali metal ion (e.g., lithium, sodium, potassium and cesium ions), an alkaline earth metal ion (e.g., magnesium, calcium and strontium ions) and an ammonium ion (e.g., organic ammonium, triethanolammonium and pyridinium ions).

In formula (I), m represents 0 or 1, and when m is 0 the compound forms an internal salt.

Compounds of formula (II) are described below in detail.

In formula (II), $R_{21}$ and $R_{22}$ have the same meanings as $R_{11}$ and $R_{12}$ in formula (I), respectively, and each of $R_{21}$ and $R_{22}$ preferably represents a sulfoethyl group, a sulfopropyl group, a sulfobutyl group, a carboxymethyl group or a carboxyethyl group.

In formula (II), $Z_{21}$ has the same meaning as $Z_{11}$ in formula (I); and $X_{21}$ and n have the same meanings as $X_{11}$ and m in formula (I), respectively.

$Z_{22}$ represents a group of atoms necessary for forming a benzoxazole nucleus or a naphthoxazole nucleus, which may have substituent(s). $Z_{22}$ is preferably a group of atoms capable of forming a benzoxazole nucleus substituted by a halogen atom, an alkyl group, an alkoxy group, an alkylthio group or an aryl group at the 5-position. The halogen atom by which the benzoxazole nucleus may be substituted includes, for example, a fluorine-atom, a chlorine atom, a bromine atom and an iodine atom, and it is preferably a bromine atom or a chlorine atom.

The alkyl group may optionally be substituted, and includes, for example, a methyl group, an ethyl group, an n-propyl group, an isopropyl group, a t-butyl group, an n-butyl group, an n-octyl group, an n-decyl group, an n-hexadecyl group, a cyclopentyl group, a cyclohexyl group, a trifluoromethyl group and a hydroxyethyl group. It is preferably a trifluoromethyl group.

The alkoxy group includes, for example, a methoxy group, an ethoxy group, a propoxy group and a methylenedioxy group, and it is preferably a methoxy group.

The alkylthio group includes, for example, a methylthio group, an ethylthio group and a propylthio group, and it is preferably a methylthio group.

The aryl group includes, for example, a phenyl group, a pentafluorophenyl group, a 4-chlorophenyl group, a 3-sulfophenyl group and a 4-methylphenyl group, and it is preferably a phenyl group.

Compounds of formulae (III) and (IV) are described below in detail.

In formulae (III) and (IV), $R_{31}$, $R_{32}$, $R_{41}$ and $R_{42}$ each represents a sulfoalkyl group or a carboxyalkyl group, preferably a sulfoethyl group, a sulfopropyl group, a sulfobutyl group, a carboxymethyl group or a carboxyethyl group.

$X_{31}$ and $X_{41}$ each has the same meaning as $X_{11}$ in formula (I). 1 and p each has the same meaning as m in formula (I).

$W_{31}$, $W_{32}$ and $W_{41}$ each represents an alkyl group having 3 or less carbon atoms, a halogen atom, an aryl group or an aryloxy group, preferably a methyl group, an ethyl group, a chlorine atom, a bromine atom, a phenyl group or a phenoxy group. More preferably, the quinoline nucleus of formulae (III) and (IV) has a methyl group or a chlorine atom at the 6-position. $W_{33}$ and $W_{42}$ each represents a halogen atom or an aryl group, preferably a chlorine atom, a bromine atom, a phenyl group or a p-tolyl group, especially preferably a chlorine atom or a phenyl group.

Specific examples of compounds of formulae (I) and (II) are given below, which, however, are not limitative.

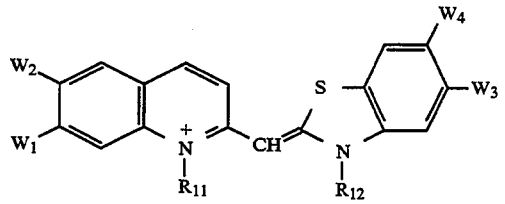

$X_{11}$

| No. | $W_1$ | $W_2$ | $W_3$ | $W_4$ | $R_{11}$ | $R_{12}$ | $X_{11}$ |
|---|---|---|---|---|---|---|---|
| I-1 | H | $CH_3$ | Cl | H | $-(CH_2)_4SO_3^-$ | $-(CH_2)_4SO_3^-$ | $HN(C_2H_5)_3^+$ |
| I-2 | $CH_3$ | $CH_3$ | Cl | $CH_3$ | $-(CH_2)_2SO_3^-$ | $-(CH_2)_4SO_3^-$ | $Na^+$ |
| I-3 | H | $CH_3$ | 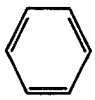 | H | $-(CH_2)_3SO_3^-$ | $-(CH_2)_2SO_3^-$ | $K^+$ |
| I-4 | H | $C_2H_5$ | 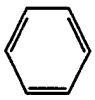 | H | $-CH_2COOH$ | $-(CH_2)_4SO_3^-$ | — |
| I-5 | H | 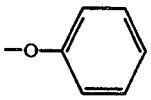 | Cl | H | $-(CH_2)_2COOH$ | $-CH_2CH_2CH(CH_3)SO_3^-$ | — |
| I-6 | H | H | H | H | $C_2H_5$ | $C_2H_5$ | $I^-$ |
| I-7 | H | $CH_3$ | OH | H | $-(CH_2)_3SO_3^-$ | $C_2H_5$ | — |
| I-8 | H | H | H | H | $C_2H_5$ | $-CH_2CH_2CH(CH_3)SO_3^-$ | — |
| I-9 | H | Cl | Cl | $CH_3$ | $-(CH_2)_4SO_3^-$ | $-(CH_2)_4SO_3^-$ | $Na^+$ |
| I-10 | H | Cl | 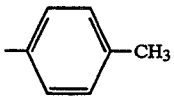 | H | $-CH_2CONHSO_2CH_3$ | $-(CH_2)_4SO_3^-$ | — |

-continued

I-11

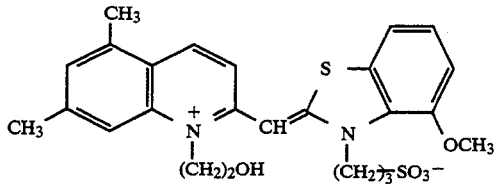

I-12

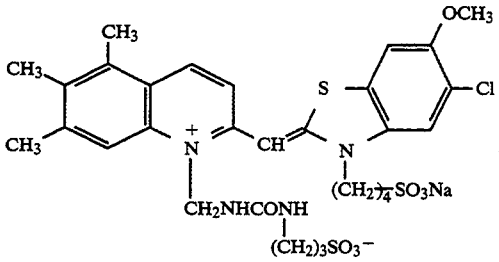

I-13

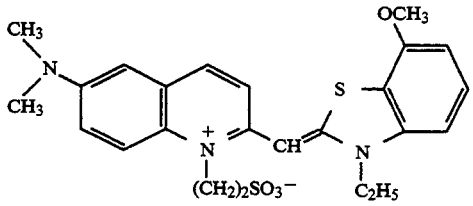

I-14

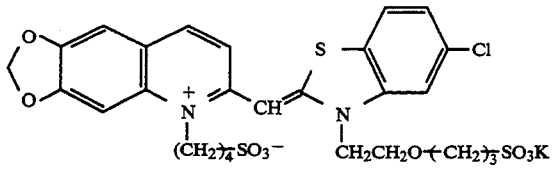

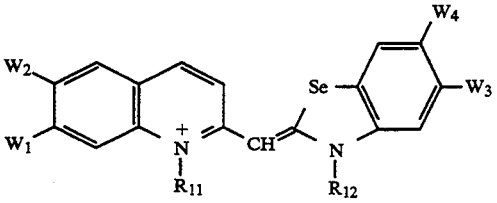

$X_{11}$

| No. | $W_1$ | $W_2$ | $W_3$ | $W_4$ | $R_{11}$ | $R_{12}$ | $X_{11}$ |
|---|---|---|---|---|---|---|---|
| I-15 | H | H | H | H | $C_2H_5$ | $C_2H_5$ | $I^-$ |
| I-16 | H | $CH_3$ | $OCH_3$ | $CH_3$ | $C_2H_5$ | $C_2H_5$ | $I^-$ |
| I-17 | H | $CH_3$ | $OCH_3$ | H | $C_2H_5$ | $-(CH_2)_4SO_3^-$ | — |
| I-18 | H | $CH_3$ | $OCH_3$ | H | $-(CH_2)_3SO_3^-$ | $-(CH_2)_3SO_3^-$ | $H^+$ |
| I-19 | H | $C_2H_5$ | Cl | H | $-(CH_2)_4SO_3^-$ | $-(CH_2)_4SO_3^-$ | $Na^+$ |
| I-20 | H | 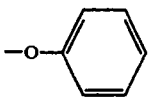 | Cl | H | $-CH_2CH_2CH(CH_3)SO_3^-$ | $-CH_2COOH$ | — |
| I-21 | $CH_3$ | $CH_3$ | Cl | H | $-(CH_2)_2SO_3^-$ | $-(CH_2)_4SO_3^-$ | $HN(C_2H_5)_3^+$ |
| I-22 | H | Cl | H | $CH_3$ | $-CH_2CONHSO_2CH_3$ | $-CH_2CONHSO_2CH_3$ | $Br^-$ |
| I-23 | H | $-N(CH_3)_2$ | H | $OCH_3$ | $-(CH_2)_2OH$ | $-(CH_2)_2SO_3^-$ | — |
| I-24 | $CH_3$ | $C_2H_5$ | OH | H | $-(CH_2)_3OCOCH_3$ | $-(CH_2)_2SO_3^-$ | — |

-continued

| | | | | | | | |
|---|---|---|---|---|---|---|---|
| I-25 | $CH_3$ | 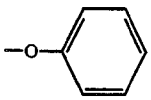 | Cl | $OCH_3$ | $-(CH_2)_4SO_3^-$ | $-(CH_2)_2NHCOCH_3$ | — |

I-26

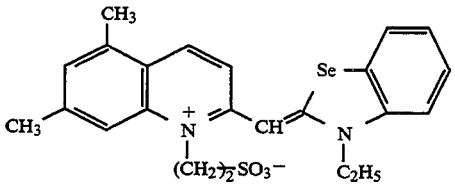

I-27

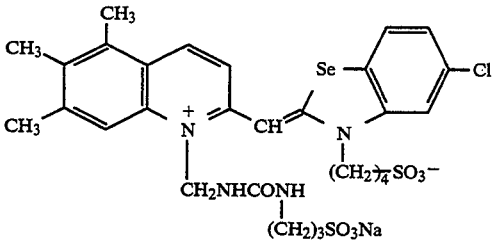

I-28

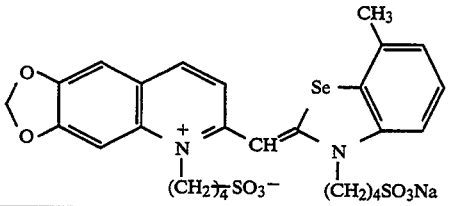

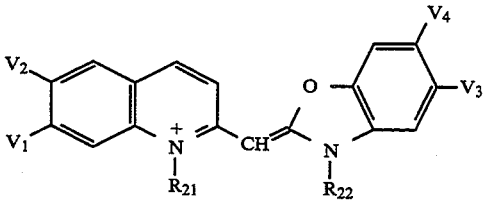

$X_{22}$

| No. | $V_1$ | $V_2$ | $V_3$ | $V_4$ | $R_{21}$ | $R_{22}$ | $X_{22}$ |
|---|---|---|---|---|---|---|---|
| II-1 | H | $CH_3$ | 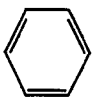 | H | $-(CH_2)_4SO_3^-$ | $-(CH_2)_4SO_3^-$ | $Na^+$ |
| II-2 | H | H | H | H | $C_2H_5$ | $C_2H_5$ | $I^-$ |
| II-3 | H | $CH_3$ | Cl | H | $-(CH_2)_2SO_3^-$ | $-(CH_2)_3SO_3^-$ | $K^+$ |
| II-4 | H | $CH_3$ | Cl | $CH_3$ | $-(CH_2)_3SO_3^-$ | $-CH_2COOH$ | — |
| II-5 | H | $CH_3$ | 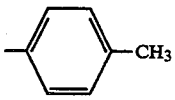 | H | $-CH_2CH_2CH(CH_3)SO_3^-$ | $-(CH_2)_4SO_3^-$ | $Na^+$ |
| II-6 | H | $C_2H_5$ | $CH_3$ | H | $CH_2CH_2OH$ | $-(CH_2)_2SO_3^-$ | — |
| II-7 | H | Cl | H | $OCH_3$ | $-(CH_2)_4SO_3^-$ | $-(CH_2)_3SO_3^-$ | $K^+$ |
| II-8 | H | 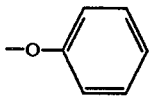 | $CH_3$ | $CH_3$ | $C_2H_5$ | $-(CH_2)_4SO_3^-$ | — |
| II-9 | $CH_3$ | H | 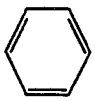 | H | $-CH_2CONHSO_2CH_3$ | $-(CH_2)_2SO_3^-$ | — |

-continued
| | | | | | | |
|---|---|---|---|---|---|---|
| II-10 | $CH_3$ | $CH_3$ | Cl | H | $-(CH_2)_4SO_3^-$ | $Na^+$ |
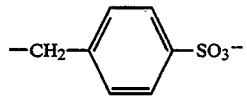
II-11
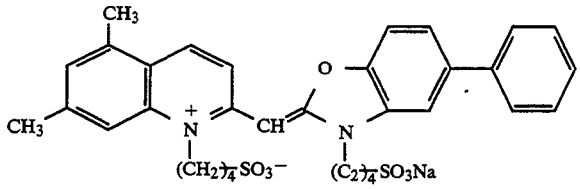
II-12
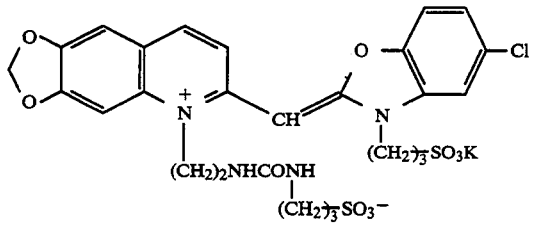
II-13
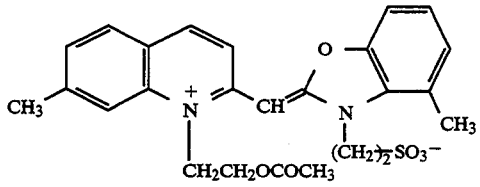
II-14
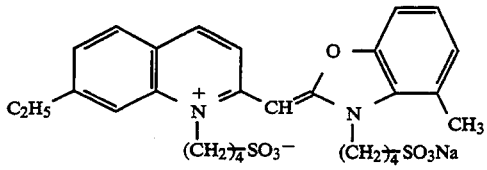
II-15
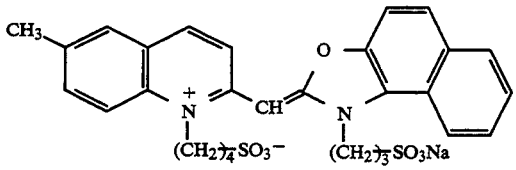
II-16
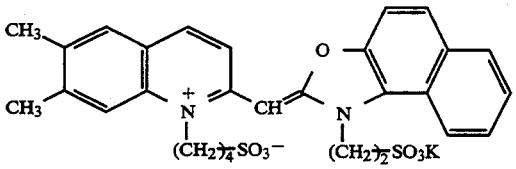
II-17
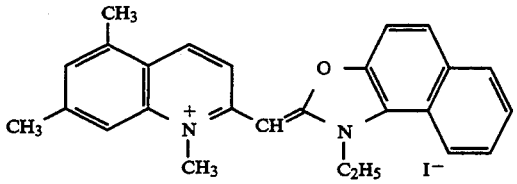
II-18
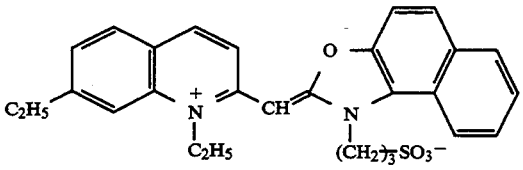

-continued
II-19
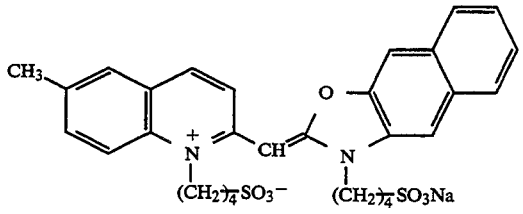
II-20
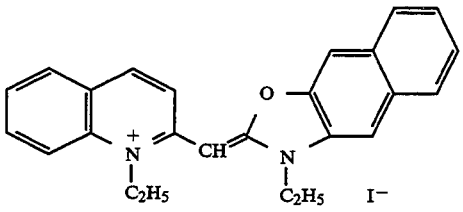
II-21
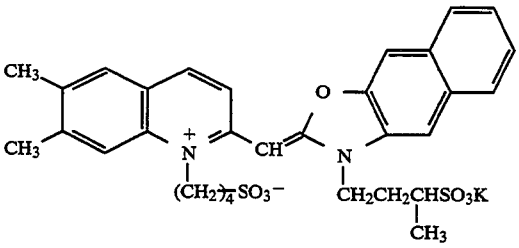
II-22
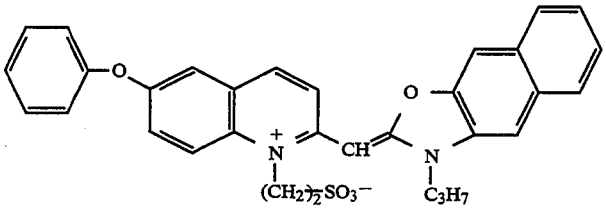
II-23
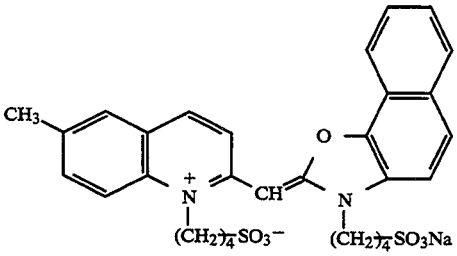
II-24
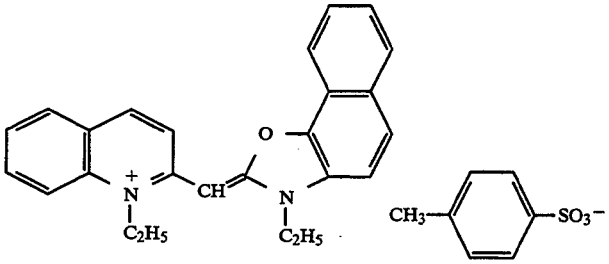

-continued
II-25
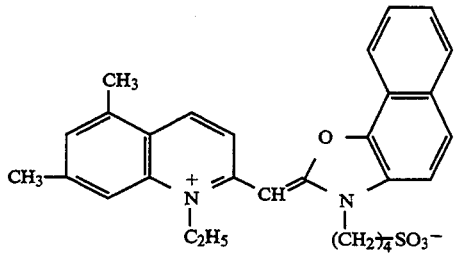
II-26
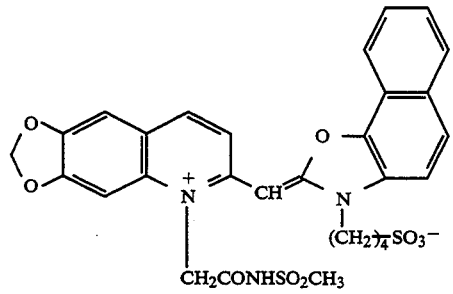
II-27
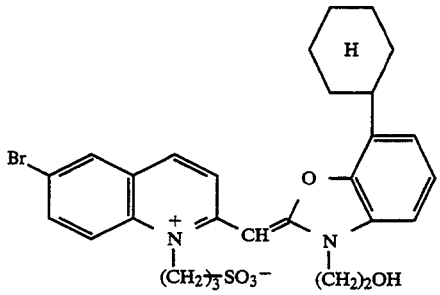
II-28
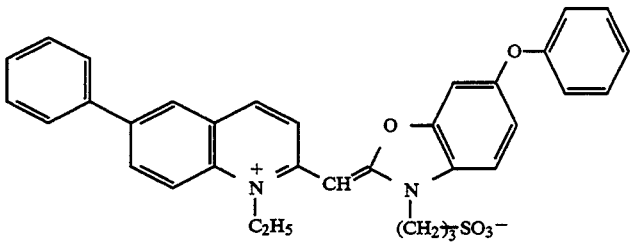
II-29
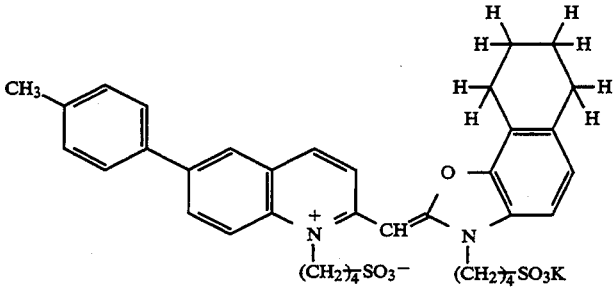
II-30
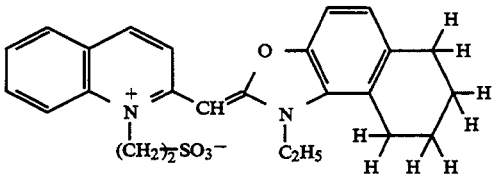
Compounds of formulae (I) and (II) for use in the present invention may be produced in accordance with Examples of production of Compound I—1 and Compound II—1 are given below.

Production of Compound I—1:

72.3 g (0.46 mol) of 2,6-dimethylquinoline and 188 g (1.4 mol) of butanesultone were heated at 145° C. for 4 hours with stirring. After being cooled to room temperature, 500 ml of acetone was added to the reaction mixture, which was cooled with ice for 30 minutes for crystallization. The crystals formed were filtered out, washed with acetone and dried to obtain 127.3 g of 4-[2,6-dimethyl-1quinolinio]butanesulfonate. The yield of the product was 94%.

Next, 102.6 g (0.36 mol) of 4-[2,6-dimethyl-1quinolinio]butanesulfonate and 166 g (0.35 mol) of 40[5-chloro-2-(4-sulfobutylthio)benzothiazolio]butanesulfonate were suspended in 1000 ml of ethanol, and 102 ml (0.73 mol) of triethylamine was added thereto and heated under reflux for 30 minutes to give crude crystals of Compound I—1. The crude crystals were filtered out and dissolved in 200 ml of methanol, and acetone was added to the resulting solution to give crystals. The crystals were concentrated and recrystallized with methanol to obtain 124 g of Compound I—1 having an HPLC purity of 99.9%. The yield of the product was 51%.

λmax (MeOH)=489.7 nm
melting point>300° C.

Production of Compound II—1:

3.25 g (10 mmol) of 4-[6-methyl-2-methylthio-1quinolinio]butanesulfonate and 3.45 g (10 mmol) of 4-[5-phenyl-2-methylbenzoxazolio]butanesulfonate were suspended in 200 ml of isopropanol, and 7 ml (50 mmol) of triethylamine was added thereto and heated under reflux for 5 hours. Next, 100 ml of isopropanol was removed by distillation, and the remaining reaction liquid was cooled in an ice bath to give crude crystals of Compound II—1. The crude crystals were filtered out and dissolved in 100 ml of methanol. 1.2 g of sodium acetate was added thereto and heated under reflux for 10 minutes, whereby the triethylamine salt of the dye was converted into its sodium salt. The crystals as precipitated out in the methanol solution by cooling it were filtered out and washed with methanol to obtain Compound II—1 having an HPLC purity of 99.9% or more. The yield of the product was 1.4 g and 19%.

λmax (MeOH)=457.8 nm (MeOH)
melting point >300° C.

To incorporate the color sensitizing dyes in the silver halide emulsions constituting the photographic material of the present- invention, the dyes may be dispersed directly in the emulsion, or alternatively, they may be dissolved in a single or mixed solvent of water, methanol, ethanol, propanol, methyl cellosolve and 2,2,3,3-tetrafluoropropanol and the resulting solution may be added to the emulsions. If desired, the dyes may be incorporated into an aqueous solution in the presence of an acid or base in accordance with the descriptions of JP-B-44-23389, JP-B-44-27555 and JP-B-57-22089 (the term "JP-"B" as used herein means an "examined Japanese patent publication"), or may be incorporated into an aqueous solution or colloidal dispersion in the presence of a surfactant in accordance with the descriptions of U.S. Pat. Nos. 3,822,135 and 4,006,025; and the resulting solution or dispersion may be added to the emulsions. In addition, the dyes may be dissolved in a substantially water-immiscible solvent such as phenoxyethanol or the like and then dispersed in water or a hydrophilic colloid, and the resulting dispersion may be added to the emulsions. Further, the dyes may be dispersed directly in a hydrophilic colloid in accordance with the descriptions of JP-A-53-102733 and JP-A-58-105141, and the resulting dispersion may be added to the emulsions.

In addition, the water-insoluble dyes may be dispersed in a water-soluble solvent without being dissolved and the resulting dispersion may be added to the emulsions in accordance with the description of JP-B-46-24185; or the dyes may be mechanically ground and dispersed in a water-soluble solvent and the resulting dispersion may be added to the emulsion in accordance with the description of JP-B-61-45217. The time of adding the dyes to the emulsions is not specifically defined but the addition may be effected at any time which has heretofore been known useful for preparing photographic emulsions. For instance, the time for the addition may be selected from the time before formation of the grains of the silver halide emulsions, the time during formation of them, the time just after formation of the grains and before washing of them with water, the time before chemical sensitization of the grains, the time during chemical sensitization of them, the time just after chemical sensitization of the grains and before cooling and solidifying the emulsions, and the time of preparing the coating liquids of the emulsions. Most ordinarily, the addition is effected after completion of chemical sensitization of the grains and before coating of the emulsions. If desired, however, the addition may also be effected along with addition of chemical sensitizing agents to the emulsions for attaining simultaneous color sensitization and chemical sensitization of the emulsions in accordance with the descriptions of U.S. Pat. Nos. 3,628,969 and 4,225,666; or the addition may be effected prior to chemical sensitization of the emulsions in accordance with the description of JP-A-58-113928; or the addition may be effected prior to completion of precipitation of the silver halide grains to initiate the color sensitization of the grains. In addition, the color sensitizing dyes may be divided into plural parts, and some parts of them are then added to the emulsions prior to chemical sensitization of the emulsions while the remaining parts are added to the emulsions after the chemical sensitization, in accordance with the teaching of U.S. Pat. No. 4,225,666. Thus, in general, the addition of the sensitizing dyes to the emulsions may be effected at any stage of forming the silver halide grains of the emulsions. If desired, the method described in U.S. Pat. No. 4,183,756 may be employed for the addition of the sensitizing dyes to the emulsions. Above all, the addition of the sensitizing dyes to the emulsions is preferably effected prior to the washing of the emulsions with water or prior to the chemical sensitization of them.

The amount of the color sensitizing dyes of formulae (I) and (II) is 50% by mol or more of the total amount of the dyes plus any other dyes to be added to the interlayer effect donating layer. The total amount of dyes of formulae (I) and (II) is substantially from $4\times10^{-6}$ mol to $8\times10^{-3}$ mol, preferably from $5\times10^{-5}$ mol to $2\times10^{-3}$ mol, per mol of the silver halide in the layer. The color sensitizing dye of formula (II) is used in an amount of from 5 to 80 mol%, preferably from 20 to 60 mol%, more preferably from 40 to 50 mol%, relative to the amount of the color sensitizing dye of formula (I). The time of adding the dyes to the emulsions is not specifically defined but the addition may be effected at any time which has heretofore been known useful for preparing photographic emulsions.

The configuration of the above-mentioned color-sensitive silver halide emulsion layers constituting the photographic material of the present invention is not specifically defined but may be any and every desired one to be defined in accordance with the object of the material.

Various light-insensitive layers such as an interlayer may be provided between the color-sensitive silver halide emulsion layers or as the uppermost or lowermost layer.

The interlayer may contain couplers and development inhibitor-releasing compounds (DIR compounds) such as those described in JP-A-61-43748, JP-A-59-113438, JP-A-59-113440, JP-A-61-20037 and JP-A-61-20038 or may also contain ordinary color mixing preventing agents.

As the constitution of the plural silver halide emulsion layers constituting the respective light-sensitive layer units, preferred is a two-layered constitution composed of a high-sensitivity emulsion layer and a low-sensitivity emulsion layer as described in JP-A-2-173632 especially for the layer (hereinafter referred to as the "C layer") having an interlayer effect to the red-sensitive layer as described in German Patent 1,121,470 and British Patent 923,045. In general, it is preferred that the plural light-sensitive layers be arranged on the support in such a way that the sensitivity degree of the layers gradually decreases in the direction of the support. In such an embodiment, a light-insensitive layer may be provided between the plural silver halide emulsion layers.

As another embodiment, a low-sensitivity emulsion layer is formed remote from the support and a high-sensitivity emulsion layer is formed near to the support, as so described in JP-A-57-112751, JP-A-62-200350, JP-A-62-206541, and JP-A-62-206543.

As specific examples of the layer constitution on the support, there are mentioned an order of low-sensitivity blue-sensitive layer (BL)/high-sensitivity blue-sensitive layer (BH)/high-sensitivity C layer (CH)/low-sensitivity C layer (CL)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; an order of BH/BL/CH/CL/GL/GH/RH/RL; and an order of BH/BL/CH/CL/GH/GL/RL/RH.

As other examples, there are mentioned an order of blue-sensitive layer/CH/GH/RH/CL/GL/RL from the remotest side from the support, as described in JP-B-55-34932; and an order of blue-sensitive layer/CL/GL/RL/CH/GH/RH from the remotest side from the support, as described in JP-A-56-25738 and JP-A-62-63936.

As a further example, there is mentioned a three-layer unit constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of this type, the sensitivity degree of each emulsion layer is gradually lowered in the direction of the support. Even in a three-layer constitution of this type, each of the same color-sensitivity layers may be composed of three layers of middle-sensitivity emulsion layer/high-sensitivity emulsion layer/low-sensitivity emulsion layer as formed in this order from the remotest side from the support, as so described in JP-A-59-202464.

As still other examples of the layer constitution of the photographic material of the present invention, there are mentioned an order of high-sensitivity emulsion layer/low-sensitivity emulsion layer/middle-sensitivity emulsion layer, and an order of low-sensitivity emulsion layer/middle-sensitivity emulsion layer/high-sensitivity emulsion layer, from the remotest side from the support.

Where the photographic material of the present invention has four or more layers, the layer constitution thereof may be varied in accordance with the manners mentioned above.

The photographic material of the present invention preferably has plural interlayer effect-donating layers (silver halide emulsion layers imparting an interlayer effect) as mentioned above. The silver halide grains to be contained in at least two layers of the plural interlayer effect-donating emulsion layers have different mean grain sizes; and an amount, per mol of silver halide, of a development inhibitor-releasing compound to be in the silver halide emulsion layer having a larger mean grain size is not more than the amount, per mol of silver halide, of the development inhibitor-releasing compound to be in the silver halide emulsion layer having a smaller mean grain size. For instance, the preferred amount, per mol of silver halide, of the development inhibitor-releasing compound is from $1\times10^{-3}$ to 10 mols in the emulsion layer having a smaller mean grain size or the low-sensitivity layer, while it is from $1\times10^{-5}$ to 0.1 mol in the emulsion layer having a larger mean grain size or the high-sensitivity layer.

The development inhibitor-releasing compound to be in the interlayer effect-donating layers constituting the photographic material of the present invention is not specifically defined but may be anyone which reacts with an oxidation product of a developing agent to release a development inhibitor. For instance, mentioned are development inhibitor-releasing compounds as described in JP-A-2-154256, JP-A-1-105947, JP-A-63-210927, JP-A-62-228151, JP-A-62-166334, JP-A-61-286852, JP-A-53-15136, JP-A-50-36125, JP-A-61-28947, JP-A-62-24252 and JP-A-3-142447.

The silver halide to be preferably in the photographic emulsion layer constituting the photographic material of the present invention is silver iodobromide, silver iodochloride or silver iodochlorobromide having a silver iodide content of about 30 mol% or less. Especially preferred is a silver iodobromide or silver iodochlorobromide having a silver iodide content of from about 2 mol% to about 10 mol%.

The silver halide grains to be in the photographic emulsions constituting the photographic material of the present invention may be regular crystalline grains such as cubic, octahedral or tetradecahedral grains, or irregular crystalline grains such as spherical or plate-like grains, or irregular crystalline grains having a crystal defect such as a twin plane, or composite crystalline grains composed of the above-mentioned regular and irregular crystalline forms.

Regarding the grain size of the silver halide grains, the grains may be fine grains having a small grain size of about 0.2 μm or less or may be large grains having a large grain size of up to about 10 μm as the diameter of the projected area. The emulsion of the grains may be either a polydisperse emulsion or a monodisperse emulsion.

The silver halide photographic emulsions to be used in the present invention may be prepared by various methods, for example, those described in *Research Disclosure* (RD) No. 17643 (Dec., 1978), pages 22 to 23 (I. Emulsion Preparation and Types); RD No. 18716 (Nov., 1979), pages 648; RD No. 307105 (Nov., 1989), pages 863 to 865; P. Glafkides, *Chimie et Physique Photographique* (published by Paul Morttel, 1967); G. F. Duffin, *Photographic Emulsion Chemistry* (published by Focal Press, 1966); and V. L. Zelikman et. al., *Making and Coating Photographic Emulsion* (published by Focal Press, 1964).

Monodisperse emulsions as described in U.S. Pat. Nos. 3,574,628 and 3,655,394 and British Patent 1,413,748 are also preferably used in the present invention.

Additionally, tabular grains having an aspect ratio of about 3 or more may also be used in the present invention. Such tabular grains may easily be prepared in accordance with various methods, for example, as described in Gutoff, *Photographic Science and Engineering*, Vol. 14, pages 248 to 257 (1970); and U.S. Pat. Nos. 4,434,226, 4,414,310, 4,433,048, 4,439,520 and British Patent 2,112,157.

Regarding the crystal structure of the silver halide grains constituting the emulsions of the invention, the grains may have the same halogen composition throughout the whole grain, or they may have different halogen compositions between the inside part and the outside part of one grain, or they may have a layered structure. Further, the grains may have different halogen compositions as conjugated by epitaxial junction, or they may have components other than silver halides, such as silver rhodanide or lead oxide, as conjugated with the silver halide matrix. Additionally, a mixture of various grains of different crystalline forms may be employed in the present invention.

The above-mentioned emulsions may be either surface latent image type emulsions capable of forming latent images essentially on the surfaces of the grains or internal latent image type emulsions capable of forming latent images essentially in the insides of the grains, or they may also be composite emulsions capable of forming latent images both on the surfaces of the grains and in the insides thereof. However, the emulsions must be negative ones. Of the latter internal latent image type emulsions, core/shell type internal latent image type emulsions described in JP-A-63-264740 are referred to. Preparation of such core/shell type internal latent image type emulsions is disclosed in JP-A-59-133542. The preferred thickness of the shell of the grains in the emulsion is, though varying in accordance with the way of development of the material, approximately from 3 to 40 nm, especially preferably from 5 to 20 nm.

The silver halide emulsions for use in the present invention are generally physically ripened, chemically ripened and/or color-sensitized. Additives to be used in such a ripening or sensitizing step are described in *Research Disclosure* Nos. 17643, 18716 and 307105, and the related descriptions in these publications are shown below.

| Kind of Additive(s) | RD No. 17643 (Dec. 1978) | RD No. 18716 (Nov. 1979) | RD No. 307105 (Nov. 1989) |
|---|---|---|---|
| 1. Chemical Sensitizer | p. 23 | p. 648, right column | p. 866 |
| 2. Sensitivity Enhancer | | p. 648, right column | |
| 3. Spectral Sensitizer, Supersensitizer | pp. 23 to 24 | p. 648, right column to p. 649, right column | pp. 866 to 868 |
| 4. Whitening Agent | p. 24 | p. 647, right column | p. 868 |
| 5. Anti-foggant, Stabilizer | pp. 24 to 25 | p. 649, right column | pp. 868 to 870 |
| 6. Light-Absorbent, Filter Dye, Ultraviolet Absorbent | pp. 25 to 26 | p. 649, right column to p. 650, left column | p. 873 |
| 7. Stain Inhibitor | p. 25, right column | p. 650, left to right column | p. 872 |
| 8. Color Image Stabilizer | p. 25 | p. 650, left column | p. 872 |
| 9. Hardening Agent | p. 26 | p. 651, left column | pp. 874 to 875 |
| 10. Binder | p. 26 | p. 651, left column | pp. 873 to 874 |
| 11. Plasticizer, Lubricant | p. 27 | p. 650, right column | p. 876 |
| 12. Coating Aid, Surfactant | pp. 26 to 27 | p. 650, right column | pp. 875 to 876 |
| 13. Antistatic Agent | p. 27 | p. 650, right column | pp. 876 to 877 |
| 14. Mat Agent | | | pp. 878 to 879 |

The present invention will be explained in more detail by way of the following examples, which, however, are not intended to restrict the scope of the present invention.

EXAMPLE 1

Plural layers each having the composition mentioned below were coated on a triacetyl cellulose support in the indicated order to form photographic material Sample Nos. 1 to 12 each having different sensitizing dyes.

Lowermost Layer:

Binder (gelatin) — 1 g/m$^2$

Fixation Accelerator represented by the formula: — 1.2 mg/m$^2$

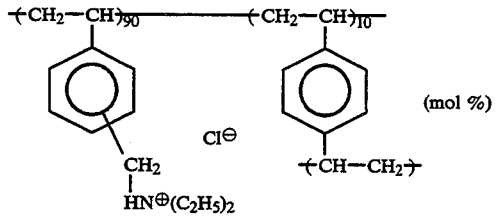

Emulsion Layer:

-continued

| | |
|---|---|
| Emulsion a: silver iodobromide emulsion (AgI 8.0 mol %; AgI-rich core-type core/shell grains with core/shell ratio of 1/2; sphere-corresponding diameter 0.72 μm; variation coefficient of sphere-corresponding diameter 28; multiple twin platelike grains having aspect ratio of diameter/thickness of 2.0) | 0.67 g/m$^2$ as Ag |
| Emulsion a: silver iodobromide emulsion (AgI 10.0 mol %; AgI-rich core-type core/shell grains with core/shell ratio of 1/3; sphere-corresponding diameter 0.40 μm; variation coefficient of sphere-corresponding diameter 15%; normal crystalline grains) | 0.22 g/m$^2$ as Ag |
| Gelatin | 0.87 g/m$^2$ |
| Sensitizing Dyes | See Table 1 |
| Coupler represented by the formula: | 0.18 g/m$^2$ |

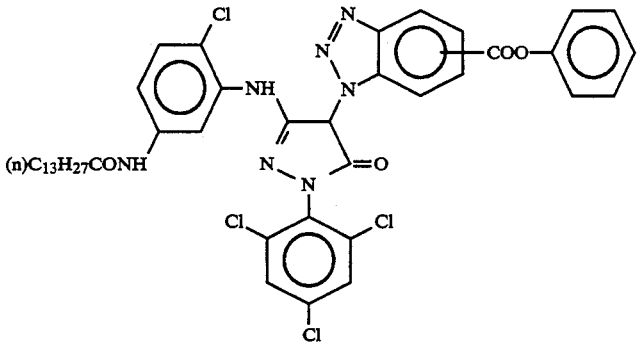

| | |
|---|---|
| Compound represented by the formula: | 0.30 g/m$^2$ |

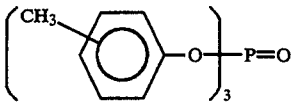

| | |
|---|---|
| Compound represented by the formula: | 3.0 × 10$^{-2}$ mol/m$^2$ |

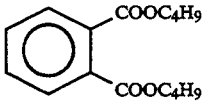

| | |
|---|---|
| Surface Protecting Layer: | |
| Binder (gelatin) | 0.7 g/m$^2$ |
| Coating Aid | 0.2 g/m$^2$ |
| Sodium N-oleoyl-N-methyltaurinate | |
| Mat Agent (Fine Grains of Polymethyl Methacrylate (mean grain size 3 μm)) | 0.13 mg/m$^2$ |

These samples were exposed to a white light through a continuous wedge and a yellow filter (Fuji Filter SC-50, produced by Fuji Photo Film Co., Ltd.) for 1/100 second and then developed in accordance with the process mentioned below.

The sensitivity of each sample is shown in Table 1 below as a value relative to the sensitivity of Sample No. 1, which is the reciprocal of the amount of exposure needed to give an optical density of fog plus 0.1.

TABLE 1

| Sample No. | Sensitizing Dye I (4.5 × 10$^{-3}$ mol/m$^2$) | Sensitizing Dye II (2.25 × 10$^{-3}$ mol/m$^2$) | Sensitivity (relative value to Sample No. 1) |
|---|---|---|---|
| 1 (comparative sample) | S-1 | | 100 |
| 2 (comparative sample) | I-1 | — | 105 |
| 3 (comparative sample) | — | II-1 | 65 |
| 4 (sample of the invention) | I-1 | II-1 | 129 |
| 5 (sample of the invention) | I-1 | II-3 | 120 |
| 6 (sample of the invention) | I-1 | II-15 | 115 |
| 7 (sample of the invention) | I-3 | II-1 | 112 |
| 8 (sample of the invention) | I-3 | II-15 | 109 |
| 9 (sample of the invention) | I-11 | II-1 | 119 |
| 10 (sample of the invention) | I-11 | II-19 | 127 |
| 11 (sample of the invention) | I-18 | II-1 | 110 |
| 12 (sample of the invention) | I-18 | II-19 | 115 |

Sensitizing Dye S-1:

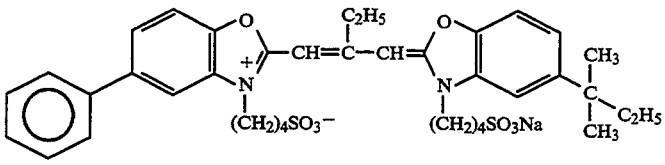

From the results shown in Table 1 above, it is understood that the combination of the sensitizing dyes of the present invention gave photographic emulsions having a higher sensitivity, as compared with the cases of the single use of the sensitizing dyes of the present invention or the other sensitizing dyes.

EXAMPLE 2

Preparation of Sample No. 101:

Plural layers mentioned below were formed on a cellulose triacetate film support having a subbing layer, to form a multi-layer color photographic material sample (Sample No. 101).

Compositions of Light-Sensitive Layers:

The numbers corresponding to the respective components mentioned below indicate the amounts coated, which were represented by the unit of g/m². For silver halides and colloidal silvers, the number indicates the amount of silver therein. For couplers, additives and gelatin, the number indicates the amount thereof as coated. For sensitizing dyes, the amount coated is represented by the unit of mols per mol of the silver halide in the same layer. The additives used are represented by the following abbreviations, whose chemical formulae are mentioned below. Where one additive compound has plural effects, one typical effect of them is referred to hereunder.

UV: Ultraviolet Absorbent
Solv: High Boiling Point Organic Solvent
ExF: Dye
ExS: Sensitizing Dye
ExC: Cyan Coupler
ExM: Magenta Coupler
ExY: Yellow Coupler
Cpd: Additive

| | |
|---|---|
| **First Layer (Anti-Halation Layer):** | |
| Black Colloidal Silver | 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-3 | $1.0 \times 10^{-3}$ |
| **Second Layer (Low-Sensitivity Red-Sensitive Emulsion Layer):** | |
| Silver Iodobromide Emulsion (AgI 4.0 mol %; uniform AgI type grains; sphere-corresponding diameter 0.4 μm; variation coefficient of sphere-corresponding diameter 30%; tabular grains having aspect ratio of diameter/thickness of 3.0) | 0.35 as Ag |
| Silver Iodobromide Emulsion (AgI 6.0 mol %; AgI-rich core-type core/shell grains with core/shell ratio of ½; sphere-corresponding diameter 0.45 μm; variation coefficient of sphere-corresponding diameter 23%; platelike grains having aspect ratio of diameter/thickness of 2.0) | 0.18 as Ag |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $2.0 \times 10^{-2}$ |
| ExC-3 | $4.0 \times 10^{-2}$ |
| ExC-4 | $2.0 \times 10^{-2}$ |
| ExC-5 | $8.0 \times 10^{-2}$ |
| ExC-6 | $2.0 \times 10^{-2}$ |
| ExC-9 | $1.0 \times 10^{-2}$ |
| **Third Layer (Middle-Sensitivity Red-Sensitive Emulsion Layer):** | |
| Silver Iodobromide Emulsion (AgI 6.0 mol %; AgI-rich core-type core/shell grains with core/shell ratio of ½; sphere-corresponding diameter 0.65 μm; variation coefficient of sphere-corresponding diameter 23%; platelike grains with aspect ratio of diameter/thickness of 2.0) | 0.65 as Ag |
| Gelatin | 1.46 |
| Exs-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $2.5 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $3.0 \times 10^{-2}$ |
| ExC-8 | $1.0 \times 10^{-2}$ |
| ExC-9 | $3.0 \times 10^{-2}$ |
| **Fourth Layer (High-Sensitivity Red-Sensitive Emulsion Layer):** | |
| Silver Iodobromide Emulsion (AgI 9.3 mol %; multi-layer grains with Ag ratio of 3/4/2, having AgI content of 24, 0 and 6 mol %, respectively, from the inside core; sphere-corresponding diameter 0.75 μm; variation coefficient of sphere-corresponding diameter 23%; platelike grains with aspect ratio of diameter/thickness of 2.5) | 0.90 as Ag |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| ExC-6 | $2.0 \times 10^{-2}$ |
| ExC-9 | $1.0 \times 10^{-2}$ |
| Solv-1 | 0.40 |
| Solv-2 | 0.15 |
| **Fifth Layer (Interlayer):** | |
| Gelatin | 0.62 |
| Cpd-1 | 0.13 |
| Polyethyl Acrylate Latex | $8.0 \times 10^{-2}$ |
| Solv-1 | $8.0 \times 10^{-2}$ |
| **Sixth Layer (Low-Sensitivity Green-Sensitive Emulsion Layer):** | |
| Silver Iodobromide Emulsion (AgI 4.0 mol %; uniform AgI type grains; sphere-corresponding diameter 0.45 μm; | 0.13 as Ag |

-continued

| | |
|---|---|
| variation coefficient of sphere-corresponding diameter 15%; tabular grains with aspect ratio of diameter/thickness of 4.0) | |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | 0.14 |
| ExM-5 | $2.1 \times 10^{-2}$ |
| Solv-1 | 0.09 |
| Solv-4 | $7.0 \times 10^{-3}$ |
| Seventh Layer (Middle-Sensitivity Green-Sensitive Emulsion Layer): | |
| Silver Iodobromide Emulsion (AgI 4.0 mol %; uniform AgI type grains; sphere-corresponding diameter 0.65 μm; variation coefficient of sphere-corresponding diameter 18%; tabular grains with aspect ratio of diameter/thickness of 4.0) | 0.31 as Ag |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.28 |
| ExM-5 | $7.2 \times 10^{-2}$ |
| ExY-1 | $5.4 \times 10^{-2}$ |
| Solv-1 | 0.23 |
| Solv-4 | $1.8 \times 10^{-2}$ |
| Eighth Layer (High-Sensitivity Green-Sensitive Emulsion Layer): | |
| Silver Iodobromide Emulsion (AgI 9.8 mol %; multi-layer grains with Ag ratio of 3/4/2, having AgI content of 24, 0 and 3 mol %, respectively, from the inside core; sphere-corresponding diameter 0.81 μm; variation coefficient of sphere-corresponding diameter 23%; multi-layer twin platelike grains with aspect ratio of diameter/thickness of 2.5) | 0.49 as Ag |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-3 | $1.0 \times 10^{-2}$ |
| ExM-4 | $3.0 \times 10^{-2}$ |
| ExY-1 | $0.5 \times 10^{-2}$ |
| ExC-1 | $0.4 \times 10^{-2}$ |
| ExC-4 | $2.5 \times 10^{-3}$ |
| ExC-6 | $0.5 \times 10^{-2}$ |
| Solv-1 | 0.12 |
| Cpd-4 | $1.0 \times 10^{-2}$ |
| Ninth Layer (Interlayer): | |
| Gelatin | 0.56 |
| Cpd-1 | $4.0 \times 10^{-2}$ |
| Polyethyl Acrylate Latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| Tenth Layer (Interlayer Effect Donor Layer to Red-Sensitive Layer): | |
| Emulsion A | 0.67 as Ag |
| Emulsion a | 0.22 as Ag |
| Gelatin | 0.87 |
| Sensitizing Dye S-1 (structure shown in Example 1) | $6.7 \times 10^{-4}$ |
| ExM-2 | 0.18 |
| Solv-1 | 0.30 |
| Solv-6 | $3.0 \times 10^{-2}$ |
| Eleventh Layer (Yellow Filter Layer: | |
| Yellow Colloidal Silver | $9.0 \times 10^{-2}$ |
| Gelatin | 0.84 |
| Cpd-2 | 0.13 |
| Solv-1 | 0.13 |
| Cpd-1 | $2.5 \times 10^{-2}$ |
| Cpd-3 | $2.0 \times 10^{-3}$ |
| H-1 | 0.25 |
| Twelfth Layer (Low-Sensitivity Blue-Sensitive Emulsion Layer): | |
| Silver Iodobromide Emulsion (AgI 9.0 mol %; multi-layer grains; sphere-corresponding diameter 0.70 μm; variation coefficient of sphere-corresponding diameter 20%; tabular grains with aspect ratio of diameter/thickness of 7.0; 50% or more of all the grains have 10 or more dislocation lines in their inside as found by observation with 200 kV transmission electronic microscope) | 0.30 as Ag |
| Silver Iodobromide Emulsion (AgI 2.5 mol %; uniform AgI type grains; sphere-corresponding diameter 0.50 μm; variation coefficient of sphere-corresponding diameter 30%; tabular grains with aspect ratio of diameter/thickness of 6.0) | |
| Gelatin | 2.18 |
| ExS-6 | $9.0 \times 10^{-4}$ |
| ExC-2 | 0.10 |
| ExY-2 | 0.05 |
| ExY-3 | 1.20 |
| Solv-1 | 0.54 |
| Thirteenth Layer: (High-Sensitivity Blue-Sensitive Emulsion Layer): | |
| Silver Iodobromide Emulsion (AgI 10.0 mol %; AgI-rich core-type grains; sphere-corresponding diameter 1.2 μm; variation coefficient of sphere-corresponding diameter 25%; multi-layer twin platelike grains with aspect ratio of diameter/thickness of 2.0) | 0.40 as Ag |
| Gelatin | 0.59 |
| ExS-6 | $2.6 \times 10^{-4}$ |
| ExY-2 | $1.0 \times 10^{-2}$ |
| ExY-3 | 0.20 |
| ExC-1 | $1.0 \times 10^{-2}$ |
| Solv-1 | $9.0 \times 10^{-2}$ |
| Fourteenth Layer (First Protective Layer): | |
| Fine Silver Iodobromide Grain Emulsion (AgI 2.0 mol %; uniform AgI type grains; sphere-corresponding diameter 0.07 μm) | 0.12 as Ag |
| Gelatin | 0.63 |
| UV-4 | 0.11 |
| UV-5 | 0.18 |
| Solv-5 | $2.0 \times 10^{-2}$ |
| Polyethyl Acrylate Latex | $9.0 \times 10^{-2}$ |
| Fifteenth Layer (Second Protective Layer): | |
| Fine Silver Iodobromide Grain Emulsion (AgI 2.0 mol %; uniform AgI type grains; sphere-corresponding diameter 0.07 μm) | 0.36 as Ag |
| Gelatin | 0.85 |
| B-1 (diameter 2.0 μm) | $8.0 \times 10^{-2}$ |
| B-2 (diameter 2.0 μm) | $8.0 \times 10^{-2}$ |
| B-3 | $2.0 \times 10^{-2}$ |
| W-4 | $2.0 \times 10^{-2}$ |
| H-1 | 0.18 |

The sample further contained, in addition to the above-mentioned components, 1,2-benzisothiazolin-3-one (200 ppm to gelatin on average), n-butyl-p-hydroxybenzoate (about 1,000 ppm to gelatin on average), and 2-phenoxy-ethanol (about 10,000 ppm to gelatin on average). In addition, it further contained B-4, B-5, B-6, F-1, F-2, F-3, F-4, F-5, F-6, F-7, F-8, F-9, F-10, F-11, F-12, as well as iron salt, lead salt, gold salt, platinum salt, iridium salt and rhodium salt.

The respective layers contained, in addition to the above-mentioned components, surfactants W-1, W-2 and W-3 as a coating aid and an emulsifying and dispersing agent.

Next, Sample Nos. 102 to 112 were prepared in the manner mentioned below.

Preparation of Sample Nos. 102 to 109:

Sample Nos. 102 to 109 were prepared in the same manner as in preparation of Sample No. 101, except that the sensitizing dye in the tenth layer of Sample No. 101 was replaced by those mentioned in Table 2 below.

Preparation of Sample Nos. 110 to 112:

Sample Nos. 110 to 112 were prepared in the same manner as in preparation of Sample No. 101, except that the tenth layer was replaced by a light-sensitive emulsion unit composed of the compositions mentioned below.

| | |
|---|---|
| Sample No. 110: | |
| 10A Layer: Low-sensitive Layer | |
| Emulsion a | 0.15 as Ag |
| Gelatin | 0.70 |
| Sensitizing Dyes | See Table 2 |
| ExM-2 | 0.15 |
| Solv-1 | 0.16 |
| Solv-6 | $2.0 \times 10^{-2}$ |
| 10B Layer: High-sensitive Layer | |
| Emulsion A | 0.68 as Ag |
| Gelatin | 0.30 |
| Sensitizing Dyes | See Table 2 |
| ExM-2 | 0.04 |
| Solv-1 | 0.04 |
| Solv-6 | $1.0 \times 10^{-2}$ |
| Sample No. 111: | |
| 10A Layer: Low-sensitive Layer | |
| Emulsion a | 0.15 as Ag |

-continued

| | |
|---|---|
| Gelatin | 0.70 |
| Sensitizing Dyes | See Table 2 |
| ExM-2 | 0.15 |
| Solv-1 | 0.16 |
| Solv-6 | $2.0 \times 10^{-2}$ |
| 10B Layer: High-sensitive Layer | |
| Emulsion A | 0.68 as Ag |
| Gelatin | 0.30 |
| Sensitizing Dyes | See Table 2 |
| ExM-2 | 0.04 |
| Solv-1 | 0.04 |
| Solv-6 | $1.0 \times 10^{-2}$ |
| Sample No. 112: | |
| 10A Layer: Low-sensitive Layer | |
| Emulsion a | 0.15 as Ag |
| Gelatin | 0.70 |
| Sensitizing Dyes | See Table 2 |
| ExM-2 | 0.15 |
| Solv-1 | 0.16 |
| Solv-6 | $2.0 \times 10^{-2}$ |
| 10B Layer: High-sensitive Layer | |
| Emulsion A | 0.68 as Ag |
| Gelatin | 0.30 |
| Sensitizing Dyes | See Table 2 |
| ExM-4 | 0.04 |
| Solv-1 | 0.04 |
| Solv-6 | $1.0 \times 10^{-2}$ |

Structural formulae of the compounds used for preparing the above-mentioned samples are given below.

UV-1

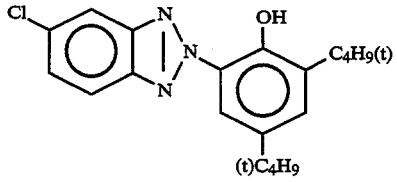

UV-2

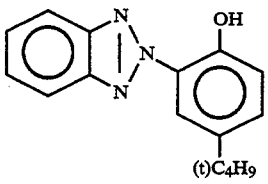

UV-3

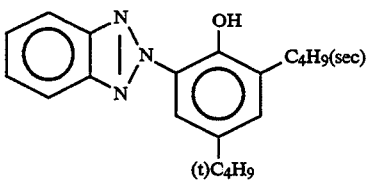

UV-4

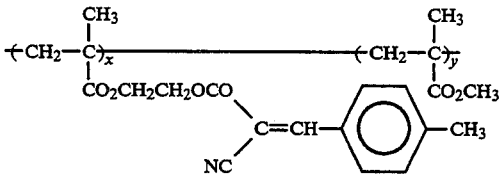

x:y = 70:30 (wt%)

UV-5

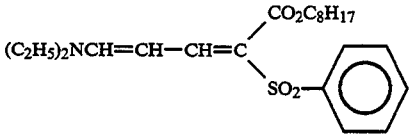

Solv-1

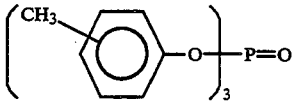

Solv-2

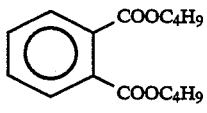

Solv-4

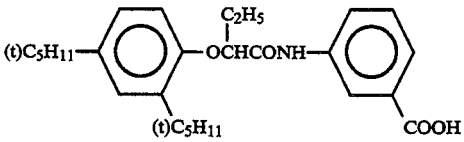

Solv-5

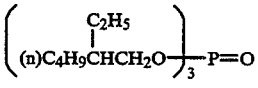

Solv-6

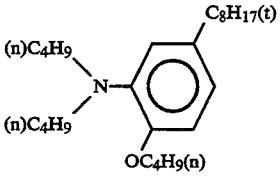

-continued
ExF-1
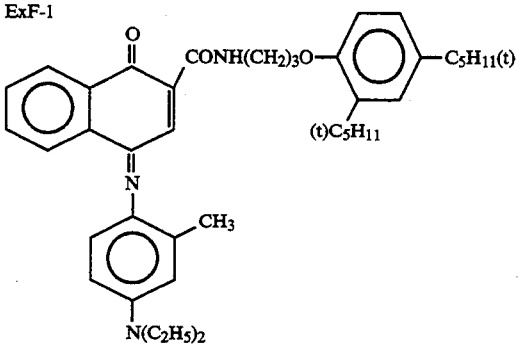
ExF-2
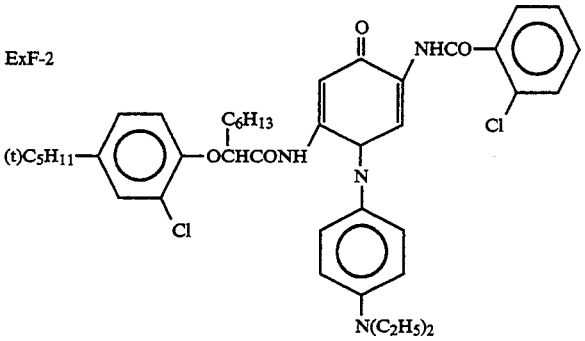
ExF-3
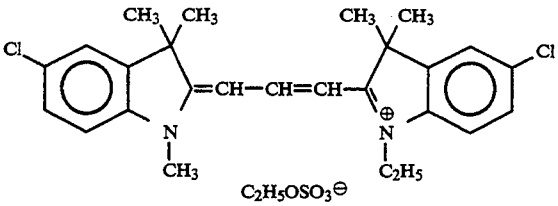
ExC-1
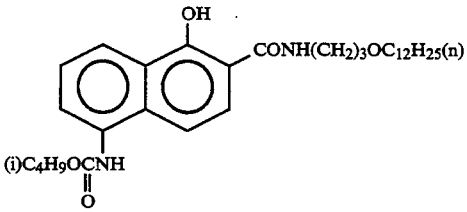
ExC-2
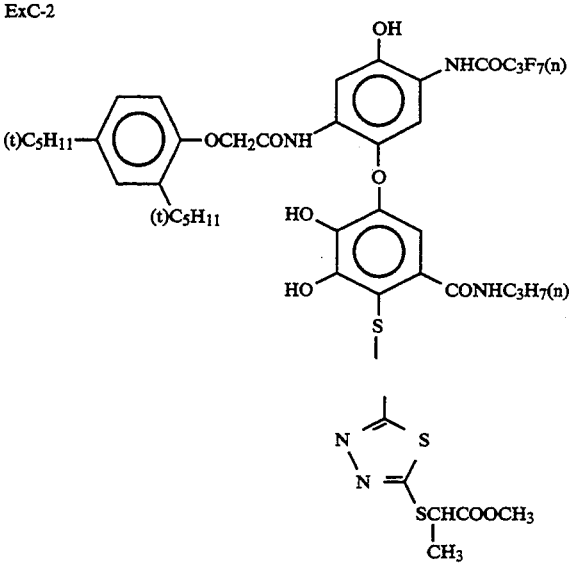
ExC-3
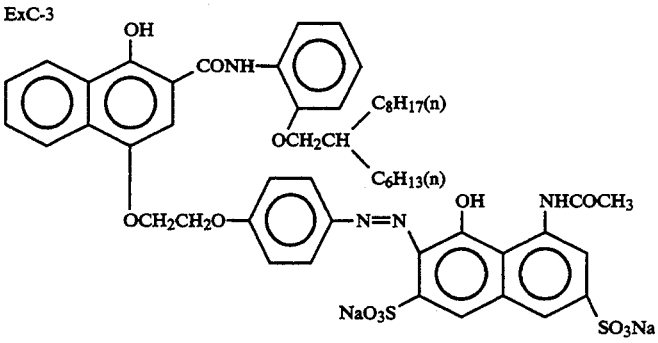
ExC-4
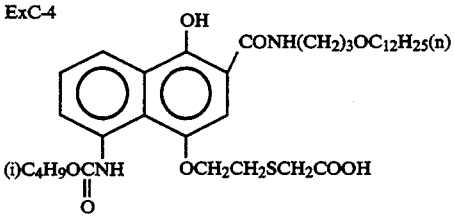

-continued
ExC-5
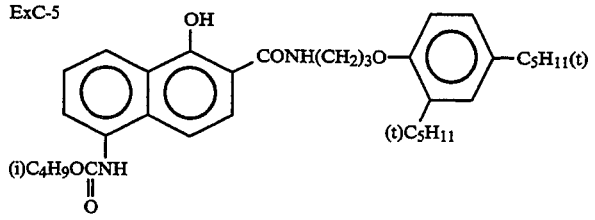
ExC-6
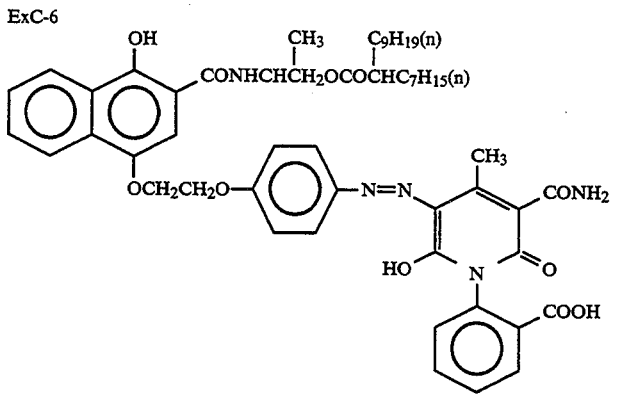
ExC-7
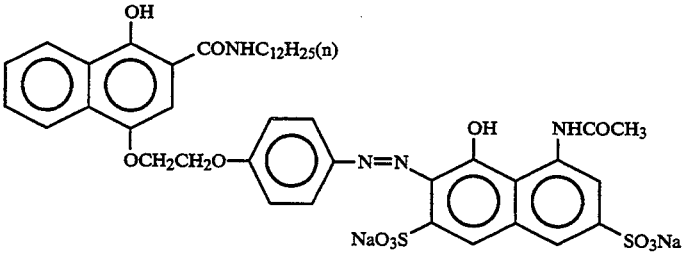
ExC-8
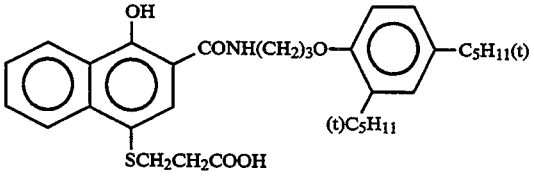
ExC-9
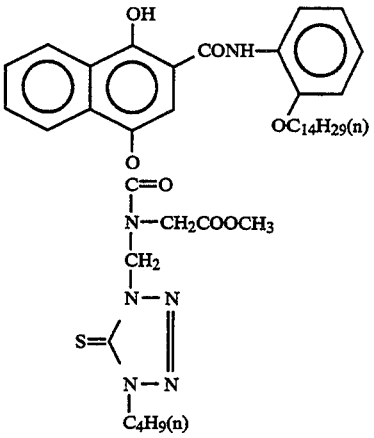

-continued
ExM-1
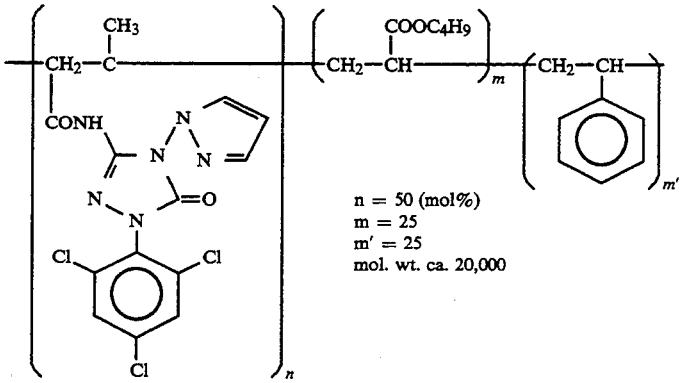
ExM-2
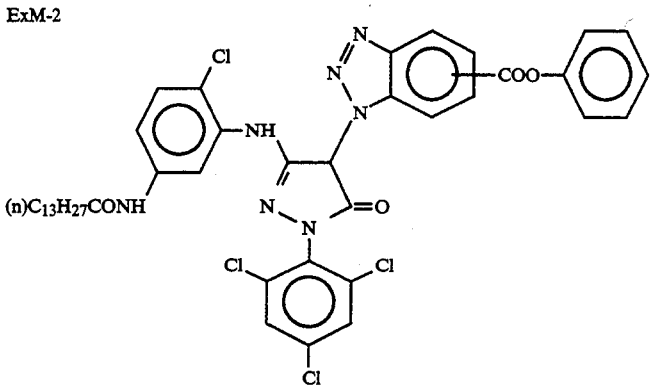
ExM-3
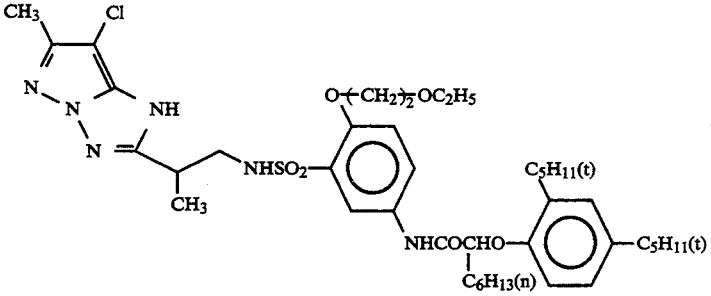
ExM-4
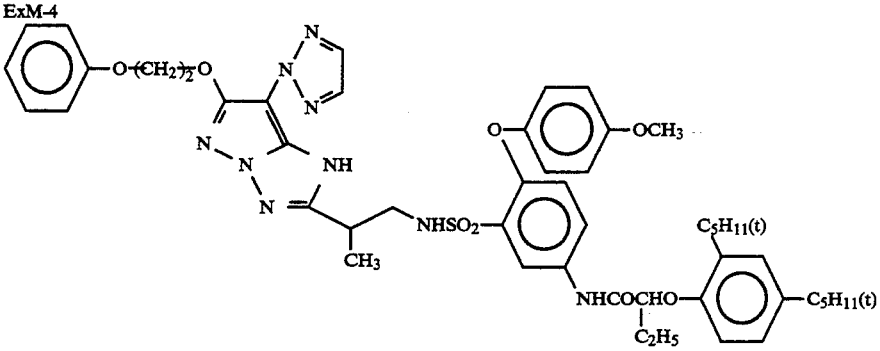

-continued
ExM-5
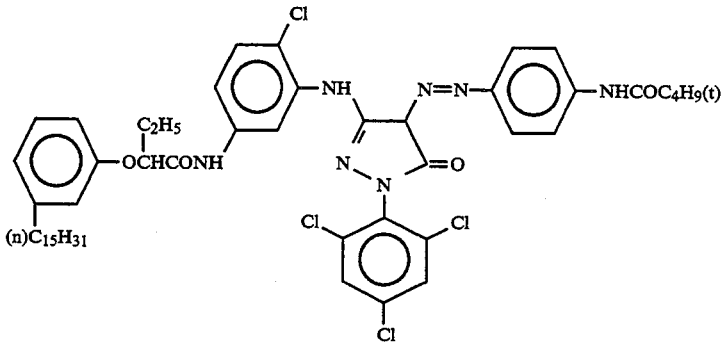
ExY-1
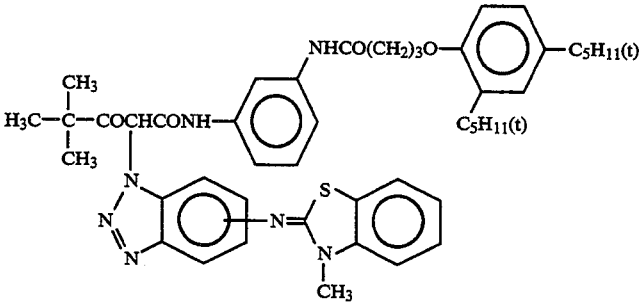
ExY-2
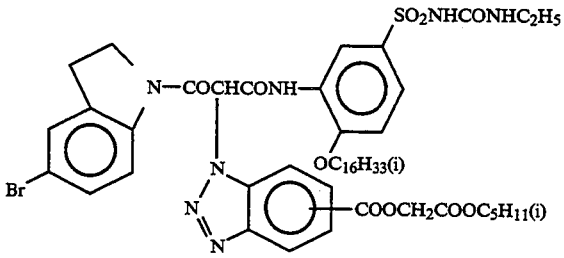
ExY-3
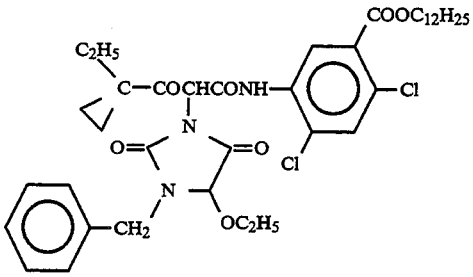
Cpd-1
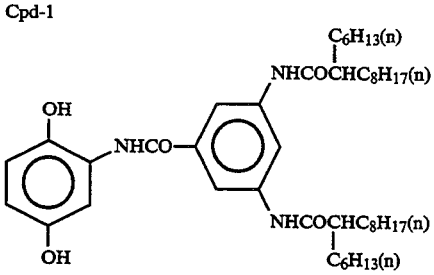
Cpd-2
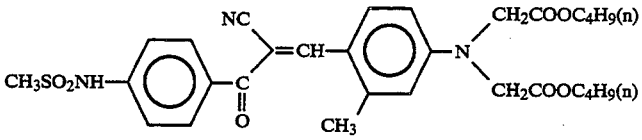
Cpd-3
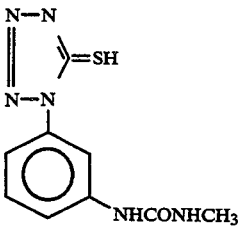
Cpd-4
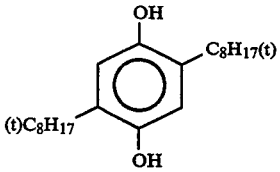
H-1
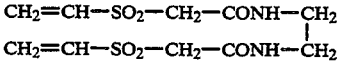

-continued
W-1
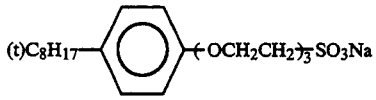
W-2
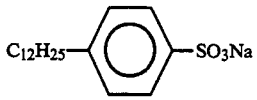
W-3
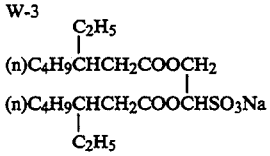
W-4
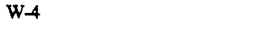
ExS-1
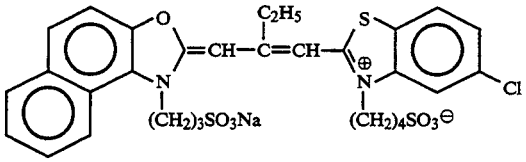
ExS-2
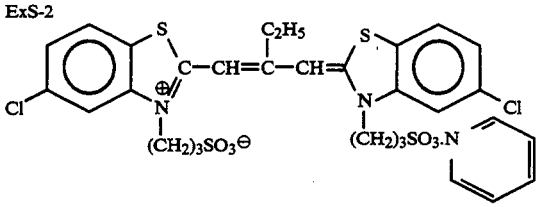
ExS-3
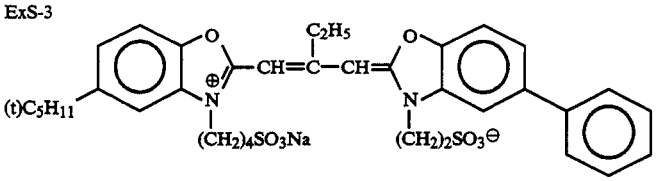
ExS-4
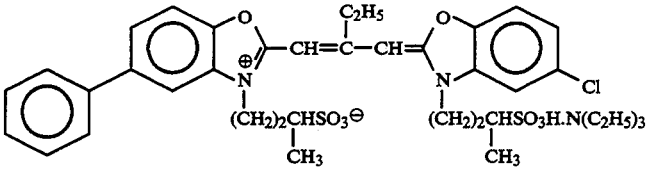
ExS-5
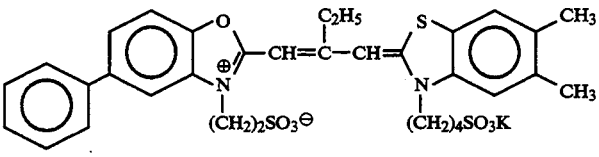
ExS-6
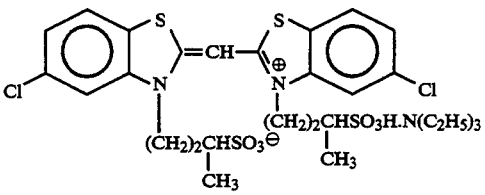
ExS-7
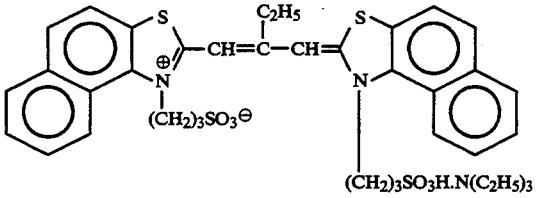
ExS-8
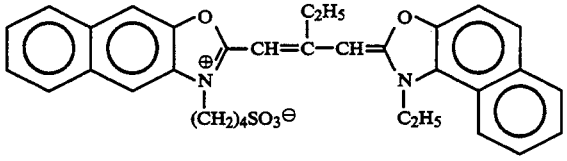

-continued

F-1

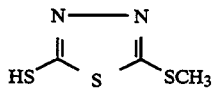

F-2

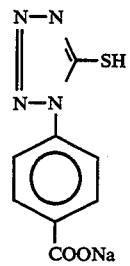

F-3

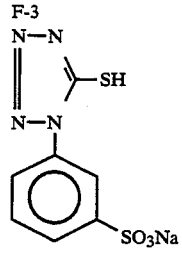

F-4

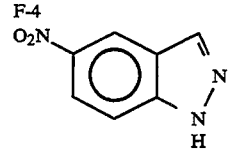

F-5

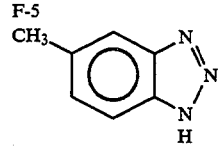

F-6

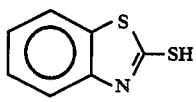

F-7

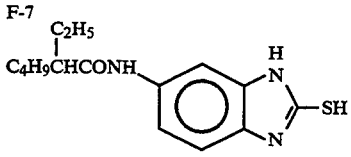

F-8

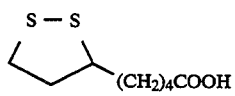

F-9

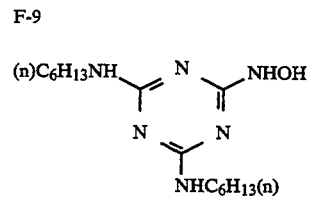

F-10

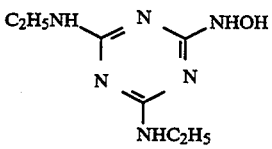

F-11

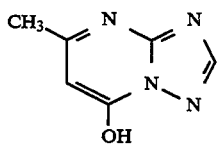

F-12

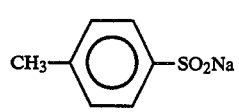

B-1

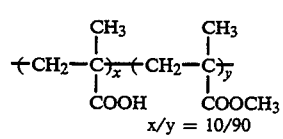

x/y = 10/90 (mol%)

B-2

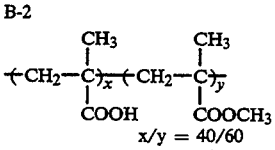

x/y = 40/60 (mol%)

B-3

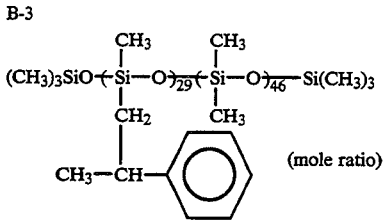

(mole ratio)

B-4

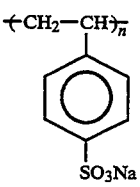

(mol. wt. ca. 10,000)

B-5

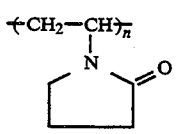

(mol. wt. ca. 10,000)

B-6

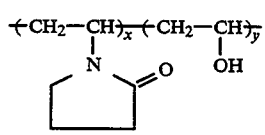

x/y = 70/30 (mol%)

Samples Nos. 101 to 112 were wedgewise exposed with a white light and then developed in accordance with the process mentioned below. All the processed samples had almost the same sensitivity and gradation.

The graininess of the magenta image of these samples was determined by an ordinary RMS (root mean square) method. Determination of the graininess of a color image by an RMS method is well known by those skilled in the art, which is described in *Photographic Science and Engineering*, Vol. 19, No. 4 (1975), pp. 235–238 with the title of "RMS Granularity; Determination of Just Noticeable Difference". For the determination, a 48 μm-aperture was used. The results of the determination are shown in Table 2 below.

For further evaluating Samples Nos. 101 to 112 with respect to the reproducibility of a spectral wavelength, the reproduced main wavelength was obtained for each sample in accordance with the method described in JP-A-62-160448 (corresponding to U.S. Pat. No. 5,053,324). The difference ($|\lambda-\lambda_0|$)) between the wavelength $\lambda_0$ of the test light and the main wavelength $\lambda$ of the reproduced color was obtained as a mean value between 450 nm and 600 nm, in accordance with the following equation. The results obtained are shown in Table 2.

$$\Delta\lambda_{450}^{600} = \frac{\int_{450}^{600} (\lambda - \lambda_0)d\lambda}{600 - 450}$$

The light from two sources was combined and used as a test light. The first light source was a spectral light having a stimulation purity of 0.7, and the second light source was a white light. Using the test light, individual samples were exposed in amounts of 0.05 lux·sec and 0.02 lux·sec, respectively. The 0.02 lux·sec exposure amount gives a good indication of the color reproducibility characteristics when the material is underexposed.

TABLE 2

| Sample No. | Sensitizing Dyes I | Sensitizing Dyes II (amount: 50 mol % of I) | RMS of Magenta D = fog + 0.5 | RMS of Magenta D = fog + 1.0 | $\Delta\lambda^{600}_{450}$ (nm) 0.05 lux · sec | $\Delta\lambda^{600}_{450}$ (nm) 0.02 lux · sec | Remarks |
|---|---|---|---|---|---|---|---|
| 101 | | S-1 | 0.0010 | 0.0009 | 2.1 | 3.6 | Comparative sample |
| 102 | I-1 | — | 0.0006 | 0.0005 | 2.2 | 3.6 | Comparative sample |
| 103 | — | II-1 | 0.0005 | 0.0004 | 1.2 | 2.2 | Comparative sample |
| 104 | I-1 | II-1 | 0.0006 | 0.0006 | 3.1 | 4.5 | Sample of the Invention |
| 105 | I-1 | II-3 | 0.0006 | 0.0006 | 2.8 | 4.3 | Sample of the Invention |
| 106 | I-1 | II-15 | 0.0007 | 0.0006 | 3.0 | 4.2 | Sample of the Invention |
| 107 | I-3 | II-1 | 0.0006 | 0.0007 | 2.9 | 4.0 | Sample of the Invention |
| 108 | I-3 | II-19 | 0.0004 | 0.0005 | 2.8 | 4.0 | Sample of the Invention |
| 109 | I-11 | II-1 | 0.0005 | 0.0004 | 3.2 | 4.2 | Sample of the Invention |
| 110 | I-11 | II-19 | 0.0006 | 0.0004 | 3.1 | 4.3 | Sample of the Invention |
| 111 | I-18 | II-1 | 0.0008 | 0.0007 | 2.7 | 3.9 | Sample of the Invention |
| 112 | I-18 | II-3 | 0.0008 | 0.0006 | 2.7 | 3.9 | Sample of the Invention |

As is noted from the results in Table 2 above, the RMS graininess of Sample Nos. 104 to 112 of the present invention was improved without significantly detracting from the color reproducibility, as compared with the comparative Sample No. 101. In particular, Samples Nos. 103 and 104 of the present invention had much improved color reproducibility while having the same graininess. From the results, the effect of the present invention is clear.

Development of the exposed samples was effected at 38° C. in accordance with the process mentioned below, using an automatic developing machine.

| Process of Development of Exposed Samples: | |
|---|---|
| Color Development | 3 min 15 sec |
| Bleaching | 1 min |
| Bleach-fixation | 3 min 15 sec |
| Washing 1 | 40 sec |
| Washing 2 | 1 min |
| Stabilization | 40 sec |
| Drying (50° C.) | 1 min 15 sec |

In the process, the washing was effected by a counter-current washing system from the washing bath 2 to the washing bath 1.

Compositions of the processing solutions used above are mentioned below.

The amount of the replenisher to the color development bath was 1200 ml per $m^2$ of the photographic material being processed, and the amount of replenisher to the other processing bathes including the washing bath was 800 ml per $m^2$ of the photographic material being processed. The amount of the carry-over from the previous bath to the washing bath was 50 ml per $m^2$ of the photographic material being processed.

| Color Developer: | Mother Solution | Replenisher |
|---|---|---|
| Diethylenetriaminepentaacetic Acid | 1.0 g | 1.1 g |
| 1-Hydroxyethylidene-1,1-diphosphonic Acid | 2.0 g | 2.2 g |
| Sodium Sulfite | 4.0 g | 4.4 g |
| Potassium Carbonate | 30.0 g | 32.0 g |
| Potassium Bromide | 1.4 g | 0.7 g |
| Potassium Iodide | 1.3 mg | — |
| Hydroxylamine Sulfate | 2.4 g | 2.6 g |
| 4-[N-ethyl-N-β-hydroxyethyl-amino]-2-methylaniline Sulfate | 4.5 g | 5.0 g |
| Water to make | 1.0 liter | 1.0 liter |
| pH | 10.0 | 10.05 |
| Bleaching Solution: | | |
| Mother solution and replenisher were the same. | | |

-continued

| | |
|---|---|
| Ammonium Ethylenediaminetetraacetato Ferrate.$2H_2O$ | 120.0 g |
| Disodium Ethylenediaminetetraacetate | 10.0 g |
| Ammonium Nitrate | 10.0 g |
| Ammonium Bromide | 100.0 g |
| Bleaching Accelerator represented by the formula: | $5 \times 10^{-3}$ mol |

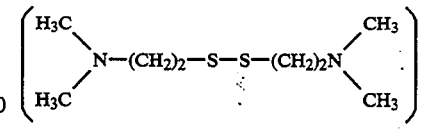

| | |
|---|---|
| Aqueous Ammonia to make | pH of 6.3 |
| Water to make | 1.0 liter |
| Bleach-fixing Solution: | |
| Mother solution and replenisher were the same. | |
| Ammonium Ethylenediaminetetra-acetato Ferrate.$2H_2O$ | 50.0 g |
| Disodium Ethylenediaminetetra-acetate | 5.0 g |
| Sodium Sulfite | 12.0 g |
| Aqueous Ammonium Thiosulfate Solution (700 g/liter) | 240 ml |
| Aqueous Ammonia to make | pH of 7.3 |
| Water to make | 1.0 liter |

Washing Water:

A city water containing 32 mg/liter of calcium ion and 7.3 mg/liter of magnesium ion was passed through a column filled with an H-type strong acidic cation-exchange resin and an OH-type strong basic anion-exchange resin so that the calcium ion content in the treated water was reduced to 1.2 mg/liter and the magnesium ion content therein was reduced to 0.4 mg/liter. 20 mg/liter of sodium dichloroisocyanurate was added to the resulting water. This was used as the washing water.

Stabilizer:

Mother solution and replenisher were the same.

| | |
|---|---|
| Formalin (37% w/v) | 2.0 g |
| Polyoxyethylene-P-monononylphenyl Ether (mean polymerization degree 10) | 0.3 g |
| Disodium Ethylenediaminetetraacetate | 0.05 g |
| Water to make | 1.0 liter |
| pH | 5.8 |

Drying

The drying temperature was 50° C.

In accordance with the present invention as described above in detail, there is provided a color photographic material having a silver halide emulsion layer capable of imparting an interlayer effect to the red-sensitive emulsion layer having a center-of-gravity wavelength falling within the range of from 500 to 560 nm. The material has an excellent color reproducibility and forms a color image having a high chroma (color saturation) and an excellent graininess.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having on a support at least one blue-sensitive silver halide emulsion layer containing at least one yellow-coloring color coupler, at least one green-sensitive silver halide emulsion layer containing at least one magenta-coloring color coupler, and at least one red-sensitive silver halide emulsion layer containing at least one cyan-coloring color coupler, and additionally having on the support at least one silver halide emulsion layer capable of imparting an interlayer effect to the red-sensitive emulsion layer, in which the layer capable of imparting an interlayer effect has been color-sensitized with at least one sensitizing dye of the general formula (III) and with at least one sensitizing dye of the general formula (IV):

(III)

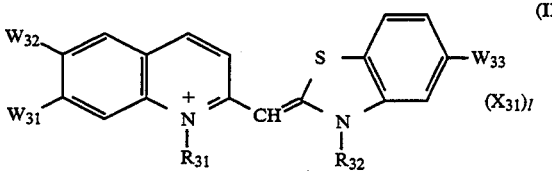

(IV)

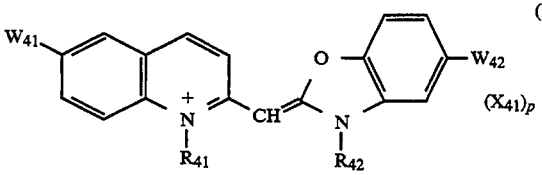

where $R_{31}$, $R_{32}$, and $R_{41}$ and $R_{42}$ each represents a sulfoalkyl group or a carboxyalkyl group;

$X_{31}$ and $X_{41}$ each represents a charge-balancing pair ion;

i and p each represents 0 or !, and where is 1 is 0 the formula (III) compound forms an internal salt, and when p is 0 the formula (IV) compound forms an internal salt, $W_{31}W_{32}$ and $W_{41}$ each represents an alkyl group having 3 or less carbon atoms, a halogen atom, an aryl group or an aryloxy group; and $W_{33}$ and $W_{42}$ each represents a halogen atom or an aryl group.

2. The silver halide photographic material of claim 1, in which the 6-position of the benzene ring formed by $Z_{11}$ is substituted by an alkyl group.

3. The silver halide photographic material of claim 2, in which the alkyl group is either a methyl group or an ethyl group.

4. The silver halide photographic material of claim 1, in which $Z_{12}$ forms a benzothiazole nucleus which is substituted at the 5-position.

5. The silver halide photographic material of claim 1, in which $Z_{22}$ represents a benzoxazole nucleus which is substituted at the 5-position.

6. The silver halide photographic material of claim 1, in which the total amount of dyes of formulae (III) and (IV) is from $4\times10^{-6}$ mol to $8\times10^{-3}$ mol per mol of the silver halide in the layer capable of imparting an interlayer effect.

* * * * *